US007652637B2

(12) United States Patent
Taki et al.

(10) Patent No.: US 7,652,637 B2
(45) Date of Patent: Jan. 26, 2010

(54) ANTENNA, AND RADIO-FREQUENCY IDENTIFICATION TAG

(75) Inventors: Kazunari Taki, Nagoya (JP); Yasumitsu Miyazaki, Kani (JP)

(73) Assignee: Brother Kogyo Kabushiki Kaisha, Nogoya-shi, Aichi-ken (JP)

( * ) Notice: Subject to any disclaimer, the term of this patent is extended or adjusted under 35 U.S.C. 154(b) by 15 days.

(21) Appl. No.: 12/018,184

(22) Filed: Jan. 22, 2008

(65) Prior Publication Data

US 2008/0191945 A1 Aug. 14, 2008

Related U.S. Application Data

(63) Continuation-in-part of application No. PCT/JP2006/310593, filed on May 26, 2006.

(30) Foreign Application Priority Data

Jul. 22, 2005 (JP) ..... 2005-212450
Jan. 16, 2006 (JP) ..... 2006-007800

(51) Int. Cl.
*H01Q 1/36* (2006.01)

(52) U.S. Cl. ..... 343/895; 343/700 MS

(58) Field of Classification Search ..... 343/700 MS, 343/895, 702
See application file for complete search history.

(56) References Cited

U.S. PATENT DOCUMENTS

| | | | | |
|---|---|---|---|---|
| 5,966,097 | A | 10/1999 | Fukasawa et al. | |
| 6,040,803 | A | 3/2000 | Spall | |
| 7,154,449 | B2 * | 12/2006 | Liu et al. | 343/867 |
| 2004/0066341 | A1 | 4/2004 | Ito et al. | |
| 2004/0189542 | A1 | 9/2004 | Mori | |
| 2005/0195124 | A1 * | 9/2005 | Puente Baliarda et al. | 343/893 |
| 2006/0220869 | A1 * | 10/2006 | Kodukula et al. | 340/572.7 |
| 2007/0222697 | A1 * | 9/2007 | Caimi et al. | 343/861 |

FOREIGN PATENT DOCUMENTS

| | | | |
|---|---|---|---|
| EP | 1359369 | | 11/2003 |
| JP | 9326632 | A | 12/1997 |
| JP | 10051223 | A | 2/1998 |
| JP | 10154906 | A | 6/1998 |
| JP | 2002504770 | A | 2/2002 |
| JP | 2002344222 | A | 11/2002 |

(Continued)

OTHER PUBLICATIONS

International Search Report for International Patent Application No. PCT.JP2006/3310593, mailed Jul. 12, 2006.

*Primary Examiner*—HoangAnh T Le
(74) *Attorney, Agent, or Firm*—Baker Botts, LLP.

(57) ABSTRACT

An antenna connected to a circuit portion and configured to effect transmission and reception of information by radio communication, the antenna including a driven meander line portion which has a feed section connected to the circuit portion and which is a line conductor formed in a meandering pattern, and a parasitic meander line portion which does not have a feed section connected to the circuit portion and which is a line conductor formed in a meandering pattern and positioned relative to the driven meander line portion, so as to influence an input impedance of the driven meander line portion. Also disclosed is a radio-frequency identification tag including the antenna.

21 Claims, 22 Drawing Sheets

FOREIGN PATENT DOCUMENTS

| | | | |
|---|---|---|---|
| JP | 2003198410 | A | 7/2003 |
| JP | 2004228797 | A | 8/2004 |
| JP | 2005092699 | A | 4/2005 |
| JP | 2005130345 | A | 5/2005 |
| JP | 2005198168 | A | 7/2005 |
| JP | 2006051446 | A2 | 4/2006 |
| WO | 9943043 | A1 | 8/1999 |
| WO | 2004070876 | A1 | 8/2004 |
| WO | 2005041349 | A1 | 5/2005 |

* cited by examiner

| OPERATIONS | COMMAND | CODES |
|---|---|---|
| TAG IDENTIFICATION | PING | 0x08 |
| | SCROLL ID | 0x01 |
| TAG WRITING | ERASE ID | 0x32 |
| | PROGRAM ID | 0x31 |
| | VERIFY | 0x38 |
| | LOCK | 0x31 |

ANTENNA, AND RADIO-FREQUENCY IDENTIFICATION TAG

CROSS REFERENCE TO RELATED APPLICATIONS

The present application is a Continuation-in-Part of International Application No. PCT/JP2006/310593 filed May 26, 2006, which claims the benefits of Japanese Patent Application No. 2005-212450 filed Jul. 22, 2005, and Japanese Patent Application No. 2006-007800 filed Jan. 16, 2006, the disclosure of which is herein incorporated by reference in its entirety.

BACKGROUND OF THE INVENTION

1. Field of the Invention

The present invention relates to improvements of an antenna suitably used for a radio-frequency identification tag capable of writing and reading information in a non-contact fashion.

2. Description of Related Art

There is known an RFID (Radio-Frequency Identification) communication system wherein a radio-frequency tag communication device (interrogator) reads out information, in a non-contact fashion, from small-sized radio-frequency identification tags (transponders) on which desired information is written. In this RFID communication system, the radio-frequency tag communication device is capable of reading out the information from the radio-frequency identification tags, even where the radio-frequency identification tags are contaminated or located at positions invisible from the radio-frequency tag communication device. For this reason, the RFID communication system is expected to be used in various fields, such as management and inspection of articles of commodity.

One of fundamental needs to be satisfied regarding the RFID communication system is to reduce the size of the radio-frequency identification tags. To reduce the size of the radio-frequency identification tags, it is particularly required to accommodate an antenna of each radio-frequency identification tag in a surface area as small as possible, while maintaining characteristics of the antenna desired for radio-frequency transmission and reception of information. An example of a structure of the antenna takes the form of a planar meander line structure. JP-2004-228797A discloses an example of a planar antenna for television reception. This planar antenna has a planar meander line structure which includes line conductors formed in a meandering or zigzag pattern so that the antenna can be accommodated in a surface area as small as possible, while maintaining the desired characteristics such as a longitudinal dimension.

However, the size reduction of the radio-frequency identification tag has a problem specific to its construction. Namely, the size reduction of the radio-frequency identification tag results in reduction of an input impedance of its antenna, and an increase of a degree of mismatch between the input impedance of the antenna and an input impedance of an IC circuit portion connected to the antenna, so that there is a risk of deterioration of the characteristics of the antenna such as its sensitivity value and communication distance. Therefore, there have been a need for developing a small-sized antenna which has a good impedance match with the IC circuit portion and which maintains desired communication characteristics, and a need for developing a radio-frequency identification tag provided with such a small-sized antenna.

SUMMARY OF THE INVENTION

The present invention was made in view of the background art described above. It is a first object of this invention to provide a small-sized antenna which has a good impedance match with a circuit portion and which maintains desired communication characteristics. A second object of this invention is to provide a radio-frequency identification tag provided with such a smalls-sized antenna.

The first object indicated above can be achieved according to a first aspect of the present invention, which provides an antenna connected to a circuit portion and configured to effect transmission and reception of information by radio communication, the antenna including a driven meander line portion which has a feed section connected to the circuit portion and which is a line conductor formed in a meandering pattern, and a parasitic meander line portion which does not have a feed section connected to the circuit portion and which is a line conductor formed in a meandering pattern, the parasitic meander line portion being positioned relative to the driven meander line portion, so as to influence an input impedance of the driven meander line portion.

The antenna according to the first aspect of this invention described above includes the driven meander line portion and the parasitic meander line portion which is positioned relative to the driven meander line portion, so as to influence the input impedance of the driven meander line portion, so that the input impedance of the driven meander line portion can be made close to the input impedance of the circuit portion, by suitably positioning the driven and parasitic meander line portions. Accordingly, a device provided with the antenna can be small-sized, with a minimum matching loss of the input impedance of the driven meander line portion with that of the circuit portion, and with minimum deterioration of communication characteristics of the antenna such as communication sensitivity and maximum communication distance. That is, the first aspect of the invention provides a small-sized antenna which has a good impedance match with a circuit portion and which maintains desired communication characteristics.

According to one preferred form of the first aspect of the invention, the parasitic meander line portion is electrically insulated from the driven meander line portion. Where the parasitic meander line portion is positioned relatively close to the driven meander line portion, the input impedance of the driven meander line portion can be stably and suitably influenced by the parasitic meander line portion.

According to a second preferred form of the invention, the driven meander line portion and the parasitic meander line portion are formed in the same plane. In this case, the driven and parasitic meander line portions need not be superposed on each other, so that the antenna and the device provided with the antenna can be easily small-sized, and the costs of manufacture of those devices can be effectively reduced.

According to a third preferred form of the invention, each of the driven and parasitic meander line portions includes a plurality of transverse conductive sections and a plurality of longitudinal conductive sections which are alternately arranged in a longitudinal direction of the antenna, and are alternately connected to each other so as to form the meandering pattern, such that distances in the longitudinal direction between one of the transverse conductive sections of the driven meander line portion and the two transverse conductive sections adjacent to the above-indicated one transverse conductive section are respectively different from distances in the longitudinal direction between one of the transverse conductive sections of the parasitic meander line portion and the two transverse conductive sections adjacent to the above-indicated one transverse conductive section of the parasitic meander line portion, in at least a part of a length of the meandering pattern in the longitudinal direction. In this case, the driven and parasitic meander lines portions can be formed in the same plane, so that the total surface area occupied by those two meander line portions can be reduced.

In one advantageous arrangement of the above-indicated third preferred form of the first aspect of the invention, the driven and parasitic meander line portions are positioned relative to each other so as to define a plurality of first portions and a plurality of second portions which are arranged at a predetermined pitch in a predetermined positional relationship with each other in the longitudinal direction, such that a center-to-center distance between the adjacent two transverse conductive sections of the parasitic meander line portion in each of the first portions minus width dimensions of the above-indicated adjacent two transverse conductive sections is larger than a sum of a center-to-center distance between the adjacent two transverse conductive sections of the driven meander line portion and the width dimensions of the adjacent two transverse conductive sections of the driven meander line portion, and such that a sum of the center-to-center distance between the adjacent two transverse conductive sections of the parasitic meander line portion in each of the second portions and the width dimensions of the adjacent two transverse conductive sections of the parasitic meander line portion is smaller than the center-to-center distance between the adjacent two transverse conductive sections of the driven meander line portion minus the width dimensions of the adjacent two transverse conductive sections of the driven meander line portion. In this case, the surface area required for the driven and parasitic meander line portions can be reduced while assuring a high degree of communication sensitivity and a sufficient maximum distance of communication of a device provided with the antenna.

In a second advantageous arrangement of the above-indicated third preferred form of the invention, the driven and parasitic meander line portions have at least one part in each of which the adjacent two transverse conductive sections of the parasitic meander line portion are interposed between the corresponding adjacent two transverse conductive sections of the driven meander line portion in the longitudinal direction of the antenna. In this arrangement, the adjacent two transverse conductive sections of the driven meander line portion are interposed between the corresponding adjacent two transverse conductive sections of the parasitic meander line portion, in at least one part corresponding to the above-described at least one part, so that the surface area required for the driven and parasitic meander line portions can be reduced while assuring a high degree of communication sensitivity and a sufficient maximum distance of communication of a device provided with the antenna.

In the above-described second advantageous arrangement, the driven and parasitic meander line portions preferably have a plurality of parts in each of which the adjacent two transverse conductive sections of the parasitic meander line portion are interposed between the corresponding adjacent two transverse conductive sections of the driven meander line portion in the longitudinal direction. In this case, the adjacent two transverse conductive sections of the driven meander line portion are interposed between the corresponding adjacent two transverse conductive sections of the parasitic meander line portion, in a plurality of parts corresponding to the above-described plurality of parts, so that the surface area required for the driven and parasitic meander line portions can be reduced while assuring the high degree of communication sensitivity and the sufficient maximum distance of communication of the device provided with the antenna.

Preferably, the plurality of parts in each of which the adjacent two transverse conductive sections of the parasitic meander line portion are interposed between the corresponding adjacent two transverse conductive sections of the driven meander line portion are located close to the above-described circuit portion. In this case, the adjacent two transverse conductive sections of the driven meander line portion are interposed between the corresponding adjacent two transverse conductive sections of the parasitic meander line portion, in the plurality of parts located close to the circuit portion, so that the surface area required for the driven and parasitic meander line portions can be reduced while assuring the high degree of communication sensitivity and the sufficient maximum distance of communication of the device provided with the antenna.

Preferably, the above-indicated plurality of parts are arranged over an entire dimension of the meandering patterns of the driven and parasitic meander line portions in the longitudinal direction of the antenna. Accordingly, the surface area required for the driven and parasitic meander line portions can be reduced while assuring the high degree of communication sensitivity and the sufficient maximum distance of communication of the device provided with the antenna.

In the above-described second advantageous arrangement of the above-indicated third preferred form of the invention, the adjacent two transverse conductive sections of the parasitic meander line portion preferably are located nearer to one of the corresponding adjacent two transverse conductive sections of the power-supply meander line portion between which the adjacent two transverse conductive sections of the parasitic meander line portion are interposed. In this case, the driven and parasitic meander line portion are positioned relative to each other, so as to maximize the input impedance of the driven meander line portion, so that the surface area required for the driven and parasitic meander line portions can be reduced while assuring the high degree of communication sensitivity and the sufficient maximum distance of communication of the device provided with the antenna.

Preferably, a center-to-center distance between the adjacent two transverse conductive sections of the parasitic meander line portion which are interposed between the corresponding adjacent two transverse conductive sections of the driven meander line portion is at least a half (½) of a center-to-center distance between the corresponding adjacent two transverse conductive sections of the driven meander line portion. In this case, the antenna has a comparatively low series resonant frequency, and a comparatively large difference between the series resonant frequency and the next parallel resonant frequency. Further, a resistance component of the input impedance is held substantially constant at the frequency in the neighborhood of the series resonant frequency.

Preferably, at least a gap distance between one of the adjacent two transverse conductive sections of the parasitic meander line portion which is nearer to the corresponding one of the adjacent two transverse conductive sections of the driven meander line portion between which the adjacent two transverse conductive sections of the parasitic meander line portion are interposed is not larger than a width of the transverse conductive sections of the driven and parasitic meander line portions. In this case, the antenna has a high degree of stability of its characteristics, and a frequency band as broad as possible.

Preferably, gap distances between the respective adjacent two transverse conductive sections of the parasitic meander line portion which are interposed between the corresponding adjacent two transverse conductive sections of the driven meander line portion are not larger than a width of the transverse conductive sections of the driven and parasitic meander line portions. In this case, the antenna has a higher degree of stability of its characteristics, and a broader frequency band.

In a third advantageous arrangement of the above-described third preferred form of the first aspect of the present invention, a total dimension of the plurality of longitudinal conductive sections of each of the driven and parasitic meander line portions in the longitudinal direction of the antenna is larger than a length of a longest one of the plurality of transverse conductive sections in a transverse direction perpendicular to the longitudinal direction. This arrangement of the driven and parasitic meander line portions makes it possible to effectively reduce the surface area required for the driven and parasitic meander line portions while assuring the high degree of communication sensitivity and the sufficient maximum distance of communication of the device provided with the antenna.

In a fourth advantageous arrangement of the above-described third preferred form, the antenna has a plurality of resonant frequency values at which an imaginary component of its input impedance is zero, and the antenna is operable at a second resonant frequency which is a second lowest of the above-indicated plurality of resonant frequency values. In this case, the input impedance of the driven meander line portion can be suitably matched with the input impedance of the circuit portion.

In a fifth advantageous arrangement of the above-described third preferred form, the feed section of the driven meander line portion which is connected to the circuit portion is provided in one of the plurality of longitudinal conductive sections of the driven meander line portion. In this case, the input impedance of the power-supply meandering portion can be suitably matched with that of the circuit portion.

In a sixth advantageous arrangement of the above-described third preferred form, the feed section of the driven meander line portion which is connected to the circuit portion is provided in one of the plurality of transverse conductive sections of the driven meander line portion. In this case, the circuit portion can be connected to the feed section at a central part of a substrate of the driven meander line portion as seen in the transverse direction of the substrate, so that the circuit portion can be positioned within the width of the substrate, whereby the antenna and the device provided with the antenna can be effectively small-sized.

In a seventh advantageous arrangement of the above-described third preferred form, the antenna further comprises a feed line section which is a line conductor, and the feed section of the driven meander line portion which is connected to the circuit portion is connected to the feed line section. In this case, the driven meander line portion is connected to the circuit portion through the feed line section having a suitable length, so that circuit portion can be short-circuited via the feed line section and the driven meander line portion, whereby electrostatic breakage of the circuit portion can be effectively prevented.

In the above-described advantageous arrangement, it is preferred that the feed line section extends parallel to the longitudinal conductive sections, and that the driven and parasitic meander line portions have longitudinal parts corresponding to the feed line section. In this case, the transverse conductive sections in the longitudinal part of the driven meander line portion have a length shorter than that of the transverse conductive sections in the other longitudinal part, and the feed line section is aligned with the longitudinal conductive sections in the longitudinal part of the driven meander line portion, so that the electrostatic breakage of the circuit portion can be effectively prevented, and the circuit portion and the feed line section can be positioned within the width of the substrate, whereby the surface area occupied by the antenna can be effectively reduced.

In a fourth preferred form of the first aspect of this invention, the driven and parasitic meander line portions have respective different conductive path lengths. In this case, the input impedance of the driven meander line portion can be easily matched with that of the circuit portion.

In a fifth preferred form of the first aspect of the invention, the antenna has a plurality of resonant frequency values at which an imaginary component of an input impedance is zero, and antenna is operable at a frequency not lower than a second resonant frequency which is a second lowest of the plurality of resonant frequency values. In this case, the input impedance of the driven meander line portion can be suitably matched with that of the input impedance of the circuit portion.

The second object indicated above can be achieved according to a second aspect of this invention, which provides a radio-frequency identification tag for radio communication with a radio-frequency tag communication device, the radio-frequency identification tag including an antenna according to the above-described first aspect of this invention, and wherein the circuit portion is an IC circuit portion having a memory portion for storing predetermined information.

In the radio-frequency identification tag including the antenna constructed according to the first aspect of the invention, the input impedance of the driven meander line portion of the antenna can be made close to the input impedance of the circuit portion, by suitably positioning the driven and parasitic meander line portions. Accordingly, the radio-frequency identification tag provided with the antenna can be small-sized, with a minimum matching loss of the input impedance of the driven meander line portion with that of the circuit portion, and with minimum deterioration of communication characteristics of the antenna such as communication sensitivity and maximum communication distance. That is, the first aspect of the invention provides a small-sized radio-frequency identification tag which has a good impedance match with a circuit portion and which maintains desired communication characteristics.

In the radio-frequency identification tag according to the second aspect of the invention, each of the driven meander line portion and the parasitic meander line portion preferably has a conductive path length which is at least ½ of a wavelength of an electromagnetic wave used for the radio communication with the radio-frequency tag communication device. In this case, the radio-frequency identification tag provided with the driven and parasitic meander line portions can be small-sized while maintaining desired communication characteristics such as high communication sensitivity and sufficient maximum communication distance.

BRIEF DESCRIPTION OF THE DRAWING

The above and other objects, features and industrial significance of this invention will be better understood by reading the following detailed description of the preferred embodiments of the invention, when considered in connection with the accompanying drawings in which.

DETAILED DESCRIPTION OF THE PREFERRED EMBODIMENTS

The preferred embodiments of the present invention will be described in detail by reference to the drawings.

Figure 1:
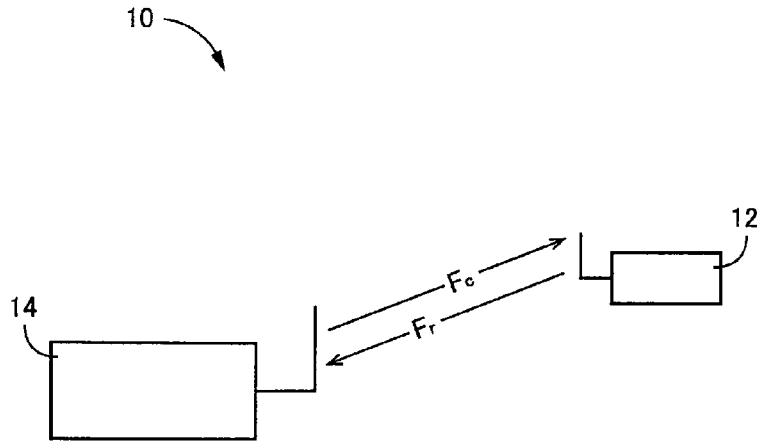
FIG. 1 is a view illustrating an RFID system including a radio-frequency identification tag in which a radio-frequency tag communication device effects radio communication with a radio-frequency identification tag provided with an antenna constructed according to the present invention.

Referring first to FIG. 1, there is illustrated a radio-frequency tag communication system 10 including at least one radio-frequency identification tag 12 (one tag 12 in the example of FIG. 1) each provided with an antenna according to the present invention, and a radio-frequency tag communication device 14 capable of effecting radio communication with each RFID tag 12. This radio-frequency tag communication system 10 is a so-called "RFID" (Radio-Frequency Identification) system in which each RFID tag 12 (hereinafter referred to as "RFID tag 12") functions as a transponder, while the radio-frequency tag communication device 14 functions as an interrogator. Described in detail, the radio-frequency tag communication device 14 is arranged to transmit an interrogating wave $F_c$ (transmitted signal) toward the RFID tag 12, and the radio-frequency tag communication device 14 which has received the interrogating wave $F_c$ modulates the received interrogating wave $F_c$ according to a predetermined information signal (data) to generate a reply wave $F_r$ (reply signal) to be transmitted toward the radio-frequency tag communication device 14, whereby radio communication is effected between the RFID tag 12 and the radio-frequency tag communication device 14, such that the radio-frequency tag communication device 14 reads out and/or writes information from or on the RFID tag 12.

Figure 2:
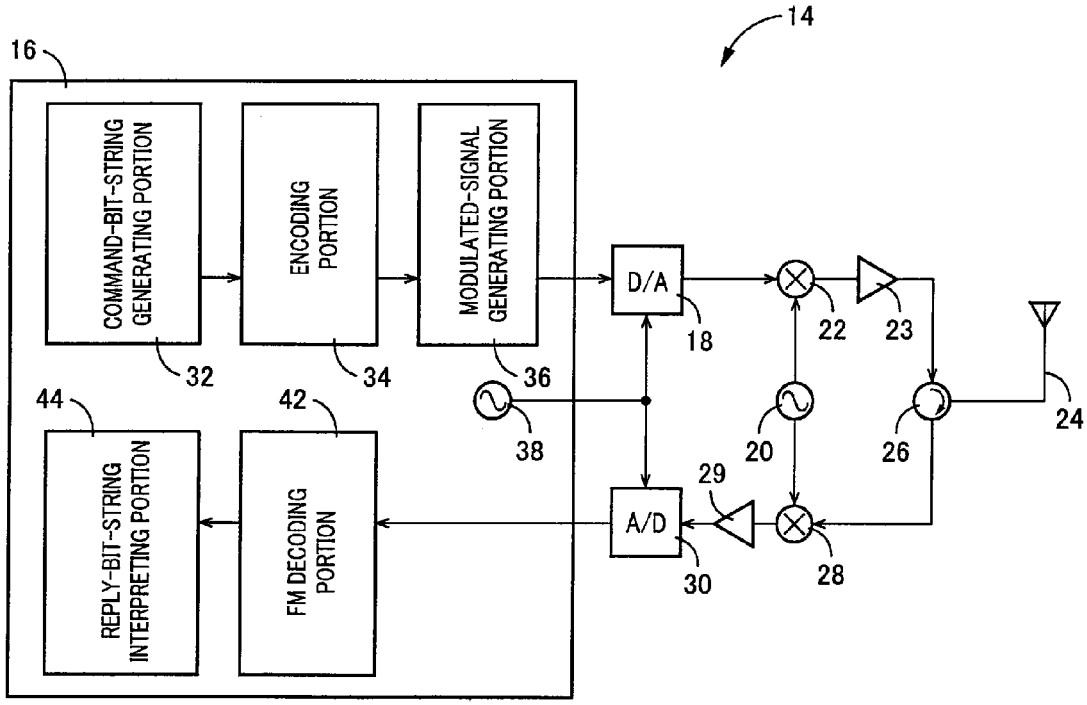
FIG. 2 is a view illustrating an arrangement of the radio-frequency tag communication device of the RFID system of FIG. 1.

The radio-frequency tag communication device 14 is arranged to effect radio communication with the radio-frequency identification tag 12, for performing at least one of the information reading from and the information writing on the radio-frequency identification tag 14. As shown in FIG. 2, the radio-frequency tag communication device 14 includes a DSP (Digital Signal Processor) 16, a transmitted-signal D/A converting portion 18, a local-signal generating portion 20, a modulator 22, a power amplifier 23, a transmitter/receiver antenna 24, a transmission/reception separating portion 26, a mixer 28, a variable-gain amplifier 29, and a received-signal A/D converting portion 30. The DSP 16 is configured to perform digital signal processing operations for generating the transmitted signal in the form of a digital signal and demodulating the reply signal received from the RFID tag 12. The transmitted-signal D/A converting portion 18 is configured to convert the digital transmitted signal generated by the DSP 16, into an analog signal. The local-signal generating portion 20 is configured to generate a predetermined carrier wave signal. The modulator 22 is configured to amplitude-modulate the carrier wave signal generated by the local-signal generating portion 20, according to the analog transmitted signal received from the transmitted-signal converting portion 18. The power amplifier 23 is configured to amplify the modulated carrier wave signal generated by the modulator 22. The transmitter/receiver antenna 24 is configured to transmit, as the interrogating signal $F_c$, the modulated carrier wave signal received from the power amplifier 23, toward the RFID tag 12, and to receive the reply wave $F_r$ transmitted from the RFID tag 12 in response to the interrogating wave $F_c$. The transmission/reception separating portion 26 is configured to apply the modulated carrier wave signal received from the power amplifier 23, to the transmitter/receiver antenna 24, and to apply the received signal received from the transmitter/receiver antenna 24, to the mixer 28. The mixer 28 is configured to multiply the received signal received from the transmitter/receiver antenna 24 through the transmission/reception separating portion 26, by the carrier wave signal received from the local-signal generating portion 20, and to effect homodyne or orthogonal detection of the received signal by eliminating a high-frequency component by a filter. The variable-gain amplifier 29 is configured to amplify the received signal detected by the mixer 28. The received-signal A/D converting portion 30 is configured to convert an output of the variable-gain amplifier 29 into a digital signal, and to apply the digital signal to the DSP 16. The transmission/reception separating portion 26 may be a circulator or a directional coupler. A low-noise amplifier configured to amplify the received signal may be disposed between the transmission/reception separating portion 26 and the mixer 28.

The DSP 16 described above is a so-called microcomputer system incorporating a CUP, a ROM and a RAM and configured to be operable to perform signal processing operations according to programs stored in the ROM, while utilizing a temporary data storage function of the RAM. The DSP 16 is provided with functional components including a command-bit-string generating portion 32, an encoding portion 34, a modulated-signal generating portion 36, a sampling-frequency oscillating portion 38, an FM decoding portion 42, and a reply-bit-string interpreting portion 44. The command-bit-string generating portion 32 is configured to generate a command bit string corresponding to the transmitted signal to be transmitted to the RFID tag 12. The encoding portion 34 is configured to encode a digital signal generated by the command-bit-string generating portion 32, according to a pulse-width method. The modulated-signal generating portion 36 is configured to generate a modulated signal for AM modulation, according to the encoded signal received from the encoding portion 34. The sampling-frequency oscillating portion 38 is configured to generate a sampling frequency for the transmitted-signal D/A converting portion 18 and the received-signal A/D converting portion 30. The FM decoding portion 42 is configured to decode the AM-demodulated wave received from the mixer 28, according to an FM method, for generating a decoded wave. The reply-bit-string interpreting portion 44 is configured to interpret the decoded signal generated by the FM decoding portion 42, and to read out the information relating to the modulation by the RFID tag 12.

Figure 3:
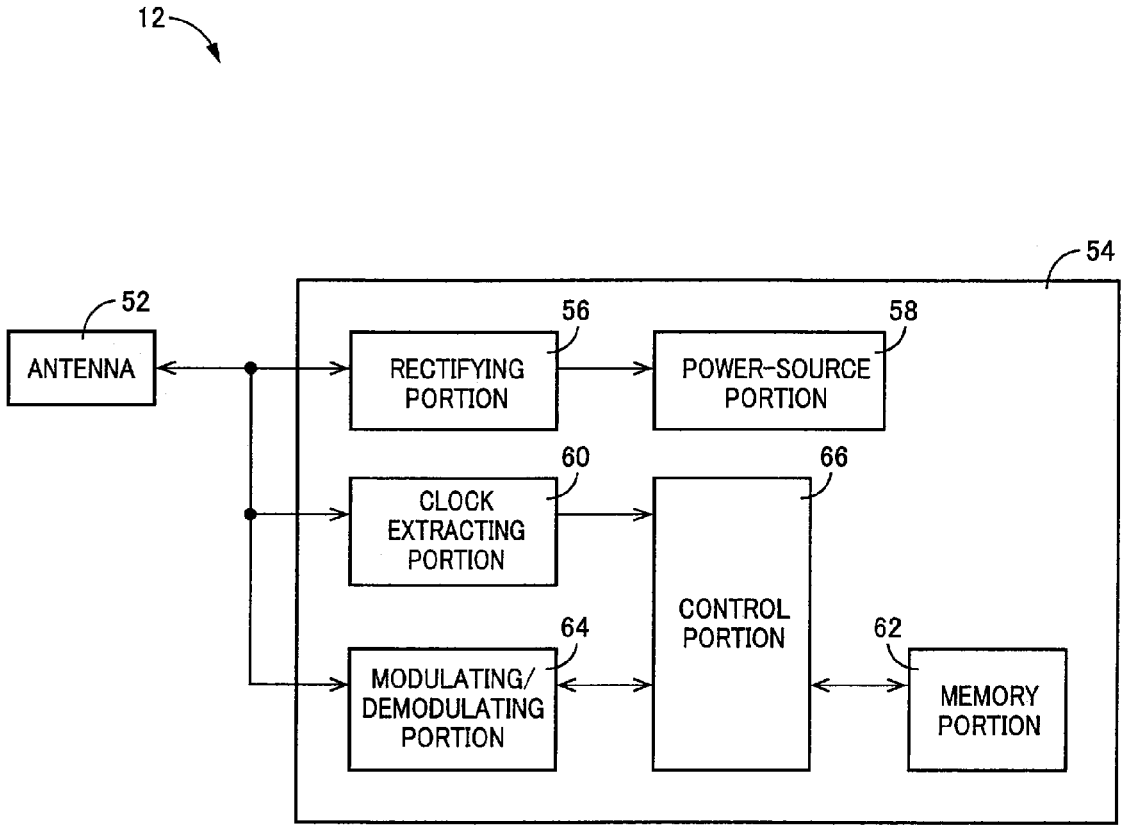
FIG. 3 is a view illustrating an arrangement of the radio-frequency identification tag construction according to one embodiment of this invention.

Referring to FIG. 3, there is illustrated an arrangement of the above-described RFID tag 12. As shown in FIG. 3, the RFID tag 12 includes an antenna 52 constructed according to one embodiment of this invention, and an IC circuit portion 54 connected to the antenna 52 and configured to process the signal transmitted from the radio-frequency tag communication device 14 and received from the antenna 52. The IC circuit portion 54 includes: a rectifying portion 56 to rectify the interrogating wave $F_c$ received from the radio-frequency tag communication device 14 through the antenna 52; a power-source portion 58 for storing an energy of the interrogating wave $F_c$ rectified by the rectifying portion 56; a clock extracting portion 60 for extracting a clock signal from the carrier wave received through the antenna 52 and applying the clock signal to a control portion 66; a memory portion 62 functioning as an information storing portion capable of storing desired information signals; a modulating/demodulating portion 64 connected to the above-described antenna 52 and configured to effect signal modulation and demodulation; and the control portion 66 for controlling the above-described rectifying portion 56, clock extracting portion 60, modulating/demodulating portion 64, etc., to control the operation of the above-described RFID tag 12 50. The control portion 66 performs basic control operations such as a control operation to store the desired information in the memory portion 62 by communication with the radio-frequency tag communication device 14, and a control operation to control the modulating/demodulating portion 64 for modulating the interrogating wave $F_c$ received through the antenna 52 on the basis of the information signals stored in the memory portion 62, and transmitting the reply wave $F_r$, as a reflected wave, through the antenna 52.

Figure 4:
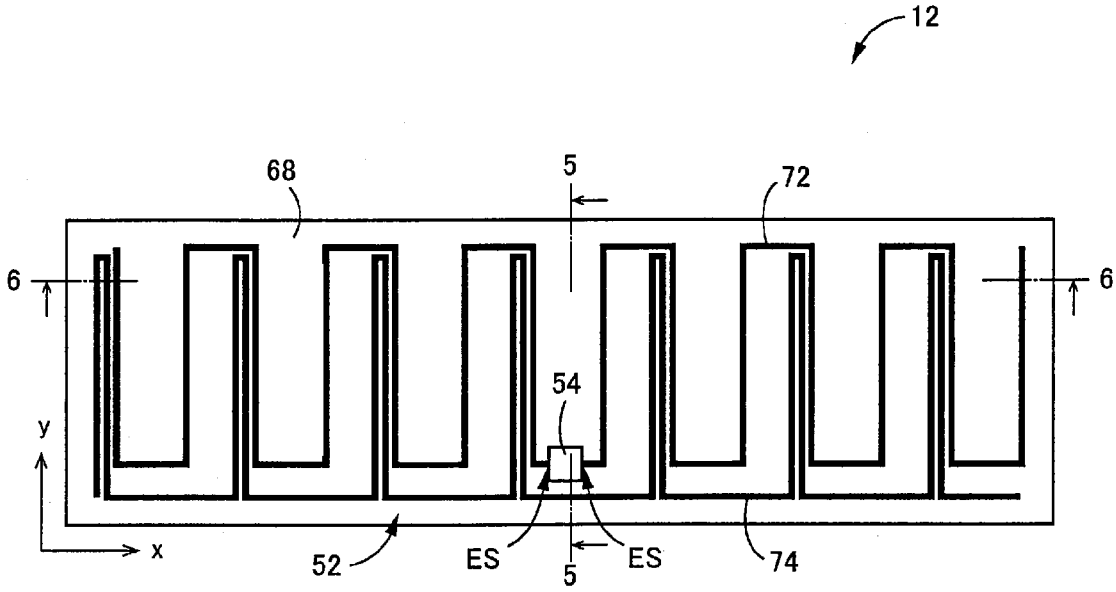
FIG. 4 is a plan view of the radio-frequency identification tag of FIG. 3.
Figure 5:
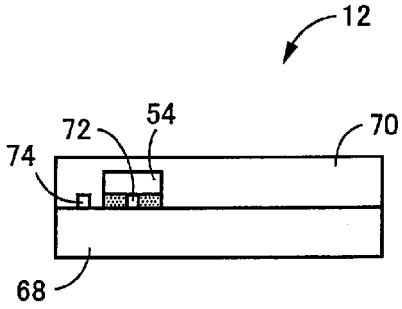
FIG. 5 is a cross sectional view taken along line 5-5 of FIG. 4.
Figure 6:
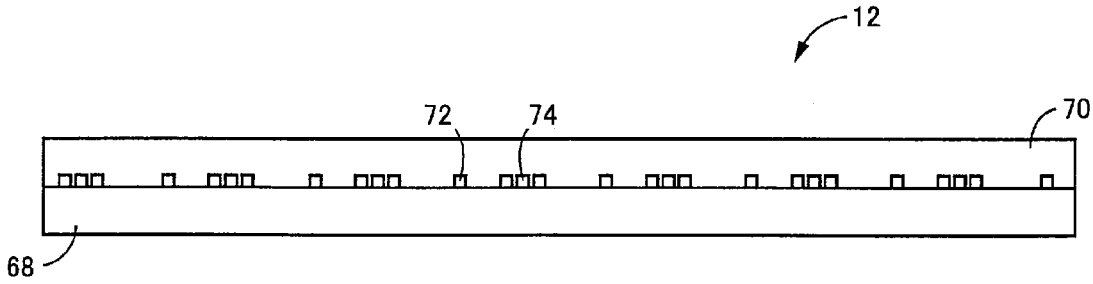
FIG. 6 is a cross sectional view taken along line 6-6 of FIG. 4.

Referring to the plan view of FIG. 4 and the cross sectional views of FIGS. 5 and 6, there is shown an arrangement of the IC circuit portion 54 of the antenna 52 of the RFID tag 12. As shown in FIGS. 4 and 5, the IC circuit portion 54 is formed on one surface of a substrate 68 in the form of a film of a suitable material such as PET (polyethylene terephthalate). As shown in FIGS. 5 and 6, the surface of the substrate 68 on which the IC circuit portion 54 is formed is covered by a protective layer 70 formed of a suitable material such as PET, to protect the antenna 52 and the IC circuit portion 54. The antenna 52 consists of a driven meander line portion 72 and a parasitic meander line portion 74 which are line conductors formed in a meandering pattern. The driven meander line portion 72 has feed sections ES connected to the IC circuit portion 54, while the parasitic meander line portion 74 does not have such feed sections ES. The parasitic meander line portion 74 is positioned relative to the driven meander line portion 74 such that the parasitic meander line portion 74 influences an input impedance of the driven meander line portion 72. The meandering pattern indicated above, which may be a serpentine pattern, is a succession of unit forms such as letter-S shapes, rectangular waves, and almost-rectangular waves having chamfered corners. The unit forms are arranged at a predetermined pitch in the longitudinal direction of the substrate 68 (RFID tag 12). In the present specific example of FIGS. 4-6, the meandering pattern is the rectangular wave pattern. Preferably, the parasitic meander line portion 74 is electrically insulated from the driven meander line portion 72.

Figure 7:
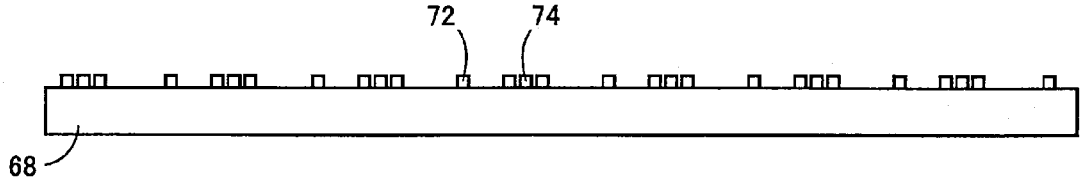
FIG. 7 is a view corresponding to that of FIG. 6, showing the radio-frequency identification tag of FIG. 3 not provided with a protective layer.

Each of the driven and parasitic meander line portions 72, 74 formed on the surface of the substrate 68 as shown in FIG. 7 is a thin strip or band of a suitable electrically conductive material such as copper, aluminum and silver, which has a width of about 0.1-3.0 mm (about 1.0 mm in this specific example) and a thickness of about 1-100 μm (16 μm in this specific example) and which is formed by a suitable forming technique such as a metal-foil or thin-film forming process, or a printing process (using a paste of silver or copper, for example). The thus formed driven and parasitic meander line portions 72, 74 are covered by the protective layer 70, as shown in FIGS. 5 and 6. Preferably, a printing operation is performed on the surface of the protective layer 70, to provide the RFID tag 12 with a printed representation indicative of the type of the RFID tag 12 and the contents of information stored in the memory portion 62, and the back surface of the substrate 68 is provided with an adhesive layer by which the RFID tag 12 is attached to a desired object such as an article of commodity, for management of the desired object by communication between the radio-frequency tag communication device 14 and the RFID tag 12.

Figure 8:
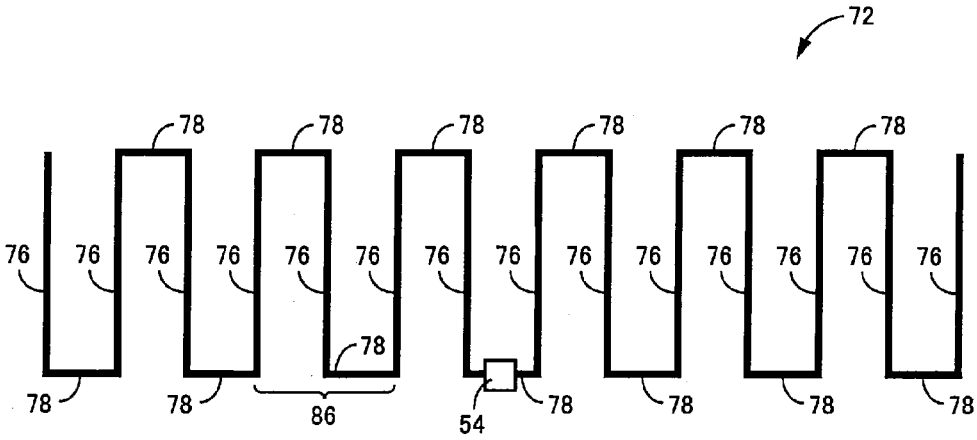
FIG. 8 is a view showing in detail an arrangement of a driven meander line portion of the antenna of the radio-frequency identification tag of FIG. 4.
Figure 9:
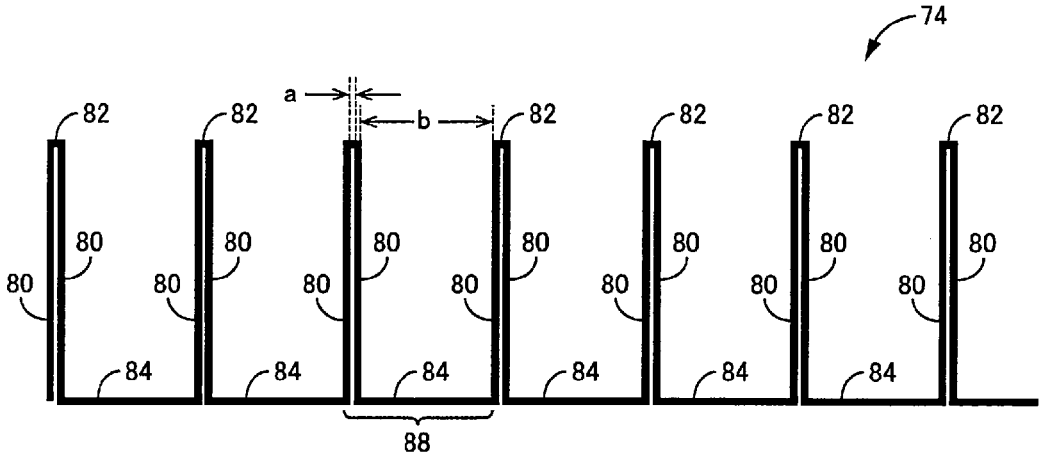
FIG. 9 is a view showing in detail an arrangement of a parasitic meander line portion of the antenna of the radio-frequency identification tag of FIG. 4.

FIG. 8 shows in detail an arrangement of the driven meander line portion 72, while FIG. 9 shows in detail an arrangement of the parasitic meander line portion 74. As shown in FIG. 8, the driven meander line portion 72 consists of a plurality of mutually parallel and straight transverse conductive sections 76 and a plurality of straight longitudinal conductive sections 78 which are alternately arranged and connected to each other so as to form a meandering or serpentine pattern. The transverse conductive sections 76 extend in the width or transverse direction of the antenna 52 (in a "y" direction indicated in FIG. 4), while the longitudinal conductive sections 78 extend in the length or longitudinal direction of the antenna 52 (in an "x" direction indicated in FIG. 4) so as to connect corresponding ends of the adjacent two transverse conductive sections 76. The IC circuit portion 54 is connected to a selected one of the plurality of longitudinal conductive sections 78 of the driven meander line portion 72, preferably, to a centrally located one of the longitudinal conductive sections 78 as seen in the longitudinal direction of the antenna 52. As shown in FIG. 9, on the other hand, the parasitic meander line portion 74 consists of a plurality of mutually parallel and straight transverse conductive sections 80 and a plurality of straight longitudinal conductive sections 82, 84, which sections 80, 82, 84 are alternately connected to each other so as to form a meandering or serpentine pattern. The transverse conductive sections 80 extend in the transverse direction of the antenna 52, while the longitudinal conductive sections 82, 84 extend in the longitudinal direction of the antenna 52. The longitudinal conductive sections 82, 84 consist of short sections 82 and long sections 84 which respectively have relatively small and large lengths in the longitudinal direction. Namely, each short section 82 connecting the adjacent two transverse conductive sections 80 which are spaced apart from each other by a relatively small distance has a length "a" while each long section 84 connecting the adjacent two transverse conductive sections 80 which are spaced apart from each other by a relatively large distance has a length "b", as indicated in FIG. 9. The lengths "a" and "b" of the short and long longitudinal conductive sections 82, 84 are determined such that a ratio a/b is 1/17. Thus, the driven meander line portion 72 has a succession of meander unit forms 86 arranged at a predetermined pitch in the longitudinal direction of the antenna 52, while the parasitic meander line portion 74 has a succession of meander unit forms 88 arranged at a predetermined pitch in the longitudinal direction. All of the meander unit forms 86 have the same dimension in the longitudinal direction of the antenna 52, and all of the meander unit forms 88 have the same dimension in the longitudinal direction.

Figure 10:
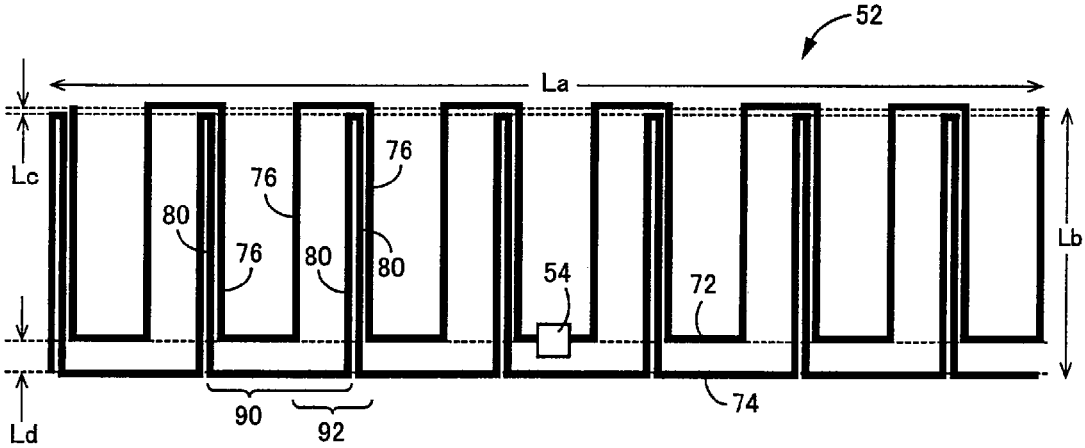
FIG. 10 is a view showing in detail an arrangement of the antenna of the radio-frequency identification tag of FIG. 4.

Referring to FIG. 10, there is shown in detail an arrangement of the antenna 52. As shown in this figure, the antenna 52 has a longitudinal dimension La of about 67 mm, and a width dimension Lb of about 18.5 mm, for example. That is, a total dimension of the longitudinal conductive sections 78 of the driven meander line portion 72 in the longitudinal direction is larger than the length of the transverse conductive sections 76, and a total dimension of the longitudinal conductive sections 82, 84 of the parasitic meander line portion 74 in the longitudinal direction is larger than the length of the transverse conductive sections 80. The driven and parasitic meander line portions 72, 74 are dimensioned and positioned relative to each other such that the upper longitudinal conductive section 78 of the driven meander line portion 72 and the corresponding upper longitudinal conductive section 82 of the parasitic meander line section 74 as seen in FIG. 10 have a distance Lc of about 0.5 mm therebetween in the transverse direction of the antenna 52, and the upper end of the transverse conductive section 76 of the driven meander line portion 72 and the corresponding upper end of the transverse conductive section 80 of the parasitic meander line portion 74 have the same distance Lc of about 0.5 mm therebetween, and such that the lower longitudinal conductive section 78 of the driven meander line portion 72 and the corresponding lower longitudinal conductive section 84 of the parasitic meander line portion 74 have a distance Ld of about 2 mm therebetween in the transverse direction. Further, the driven meander line portion 72 and the parasitic meander line portion 74 have respective different total lengths (conductive path lengths). Namely, the driven meander line portion 72 has a total length of about 280 mm, while the parasitic meander line portion 74 has a total length of about 317 mm. Preferably, the total length (conductive path length) of each of the two meander line portions 72, 74 is at least ½ of a wavelength of the carrier wave of an electromagnetic wave in the form of the above-described interrogating wave $F_c$ used for radio communication between the RFID tag 12 and the radio-frequency tag communication device 14.

In the parasitic meander line portion 74 described above, the short longitudinal conductive section 82 connecting the upper ends of the adjacent two transverse conductive sections 80 which are spaced apart from each other by the relatively small distance and the long longitudinal conductive section 84 connecting the upper ends of the adjacent two transverse conductive sections 80 which are spaced apart from each other by the relatively large distance have the respective different lengths "a" and "b". Namely, the adjacent two transverse conductive sections 80 have one of two different distances in the longitudinal direction of the antenna 52. In the driven meander line portion 72, all of the longitudinal conductive sections 78 have the same length in the longitudinal direction. Namely, the adjacent two transverse conductive sections 76 have a single distance in the longitudinal direction. Thus, the meander unit forms 86 of the driven meander line portion 72 and the meander unit forms 88 of parasitic meander line portion 74 have different shapes even if those two unit forms 86, 88 are elongated or shortened in the longitudinal direction of the antenna 52 by respective different ratios. Accordingly, the driven meander line portion 72 and the parasitic meander line portion 74 can be positioned relative to each other within a minimum surface area in the same plane, as shown in FIG. 10, such that the two meander line portions 72, 74 are electrically insulated from each other.

As also shown in FIG. 10, the driven meander line portion 72 and the parasitic meander line portion 74 are positioned relative to each other so as to define a plurality of first parts 90 and a plurality of second parts 92 which are arranged at a predetermined pitch in a predetermined positional relationship with each other in the longitudinal direction of the antenna 52. In each first part 90, a center-to-center distance between the adjacent two transverse conductive sections 80 of each meander linear form 88 of the parasitic meander line portion 72 minus the width dimensions of the adjacent two transverse conductive sections 80 is larger than a sum of a center-to-center distance between the adjacent two transverse conductive sections 76 of the driven meander line portion 72 and the width dimensions of the adjacent two transverse conductive sections 76. In each second part 92, a sum of the center-to-center distance between the adjacent two transverse conductive sections 80 of the meander linear form 88 and the width dimensions of the adjacent two transverse conductive sections 80 is smaller than the above-indicated center-to-center distance between the adjacent two transverse conductive sections 76 minus the width dimensions of the adjacent two transverse conductive sections 76. The center-to-center distance is a distance between the widthwise center lines of the adjacent two transverse conductive sections 76, 80. In each second part 92 described above, the adjacent two transverse conductive sections 80 of the parasitic meander line portion 74 are interposed between the corresponding adjacent two transverse conductive sections 76 of the driven meander line portion 72, in the longitudinal direction of the antenna 52. In each first part 90, the adjacent two transverse conductive sections 76 are interposed between the corresponding adjacent two transverse conductive sections 80 in the longitudinal direction of the antenna 52. In the example of FIG. 10, the driven and parasitic meander line portions 72, 74 have a total of six first parts 90 and a total of six second parts 92. Thus, the antenna 52 is provided with the driven meander line portion 72 and the parasitic meander line portion 74 which are positioned relative to each other, so as to define the first and second parts 90, 92 such that the adjacent two transverse conductive sections 80 of the parasitic meander line portion 74 are located nearer to one of the adjacent two transverse conductive sections 76 between which the adjacent two transverse conductive sections 80 are interposed. This mutual interposition of the driven and parasitic line portions 72, 74 permits the parasitic meander line portion 74 to greatly influence an input impedance of the driven meander line portion 72, as described below.

Figure 11:
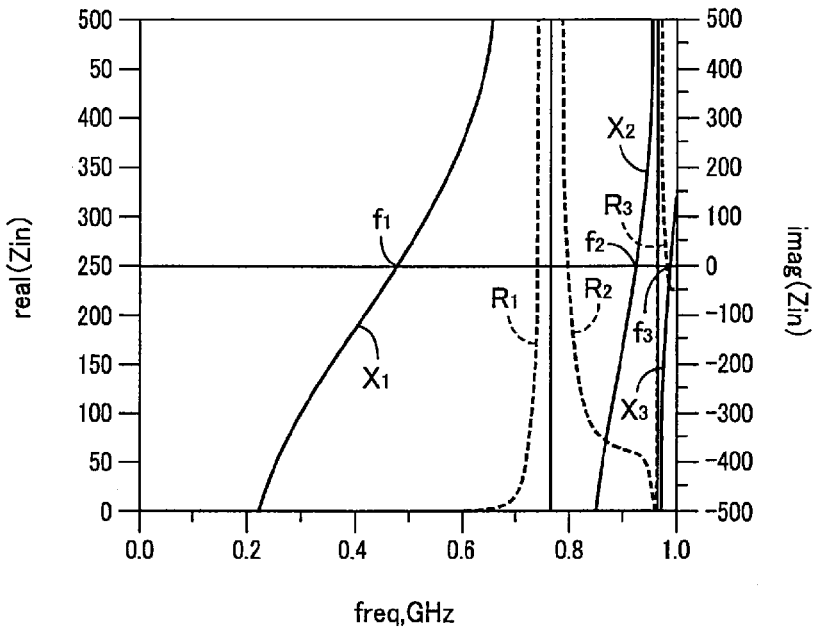
FIG. 11 is a view for explaining an input impedance of the antenna of the radio-frequency identification tag of FIG. 4, wherein solid line curves represent resonant frequency while broken line curves represent resistance (radiation resistance)

Referring to FIG. 11 for explaining the input impedance of the antenna 52, solid line curves represent an imaginary component of the input impedance, that is, an admittance, while broken line curves represent a resistance (radiation resistance). Where the frequency at which the admittance (imaginary component of the input impedance) of the input impedance is zero is defined as the resonant frequency, the curves representative of series resonant frequency and curves representative of parallel resonant frequency (lines almost parallel to the vertical axis) are alternately located along the horizontal axis along which the frequency is taken, as indicated in FIG. 11. The frequency used for the radio communication of the RFID tag 12 with the radio-frequency tag communication device 14 is in the neighborhood of 800-950 MHz. At the frequency in this frequency band at which the imaginary component of the parallel resonant frequency is zero, the resistance component is substantially infinite. Regarding the curves representative of the series resonant frequency, the resistance represented by the curve $R_1$ corresponding to the curve $X_1$ representative of the lowest first resonant frequency is substantially zero at the frequency fi in the neighborhood of 500 MHz at which the imaginary component of the series resonant frequency is zero. In this case, the antenna 52 is not operable in a satisfactory manner. However, the resistance represented by the curve $R_2$ corresponding to the curve $X_2$ representative of the second lowest resonant frequency is about 50Ω at the frequency $f_2$ in the neighborhood of 920 MHz at which the imaginary component of the series resonant frequency is zero. In this case, the antenna 52 has an input impedance high enough to permit the antenna 52 to be operated in a satisfactory manner. Further, the resistance represented by the curve $R_3$ corresponding to the curve $X_3$ representative of the third lowest third resonant frequency is about 230Ω at the frequency $f_3$ in the neighborhood of 980 MHz at which the imaginary component of the series resonant frequency is zero. In this case, too, the antenna 52 has an input impedance high enough to permit the antenna 52 to be operated in a satisfactory manner. Thus, the antenna 52 according to the present embodiment has a plurality of resonant frequency values (series resonant frequency values) at which the imaginary component of the input impedance is zero. Accordingly, the antenna 52 of the RFID tag 12 can function in the intended manner, at the second, third, and subsequent resonant frequency values.

Figure 12:
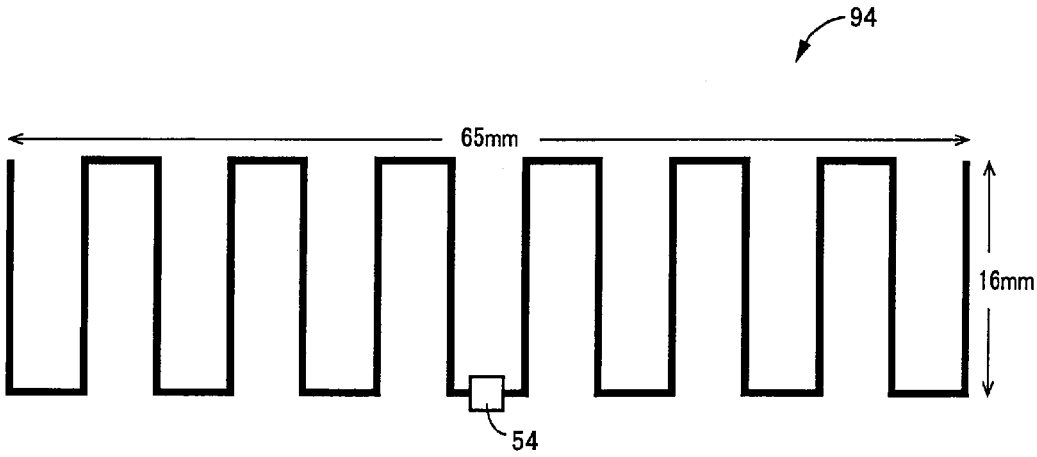
FIG. 12 is a view illustrating a conventional meander line antenna which is equivalent to the antenna of the present embodiment, except in that the conventional meander line antenna is not provided with the parasitic meander line portion.
Figures 13, 14:
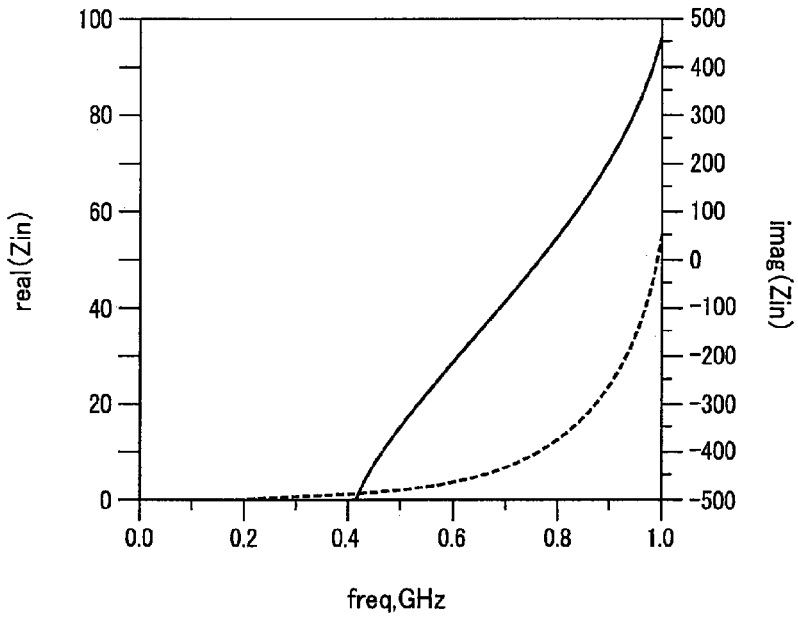
FIG. 13 is a view corresponding to that of FIG. 11, for explaining an input impedance of the conventional meander line antenna, wherein solid line curves represent resonant frequency while broken line curves represent resistance (radiation resistance)
FIG. 14 is a view indicating commands used for radio communication with the radio-frequency identification tag of FIG. 3.

Referring next to FIG. 12 illustrating a conventional meander line antenna 94 for comparison with the antenna 52 of the present embodiment. This conventional meander line antenna 94 is equivalent to the antenna 52 of the present embodiment except in that the conventional meander line antenna 94 does not have the parasitic meander line portion 74. FIG. 13 is a view corresponding to that of FIG. 11, for explaining the input impedance of the conventional meander line antenna 94, wherein solid line curves represent the imaginary component of the input impedance, namely, the admittance, while broken line curves represent the resistance (radiation resistance). In the conventional meander line antenna 94 of FIG. 13 not having the parasitic meander line portion 74, the resistance represented by the curve corresponding to the curve representative of the imaginary component of the input impedance, that is, the admittance is about 10Ω at the frequency in the neighborhood of 760 MHz at which the admittance is zero. Where the RFID tag 12 were provided with the conventional meander line antenna 94, the antenna 94 would have a high degree of mismatch with the input impedance of the RFID tag 12, giving rise to deterioration of the communication characteristics such as communication sensitivity and maximum communication distance. On the other hand, the antenna 52 constructed according to the present embodiment of the invention has a comparatively high input impedance of 50Ω or higher in the frequency band of about 800-950 MHz which is used for the radio communication of the RFID tag 12 with the radio-frequency tag communication device 14. Accordingly, the RFID tag 12 can be small-sized while maintaining good communication characteristics such as the communication sensitivity and maximum communication distance. That is, the input impedance of the RFID tag 12, which differs depending upon the arrangement of the RFID tag 12, is generally higher than 50-60Ω. The reception voltage of the RFID tag 12 having a good match with the input impedance of the antenna 52 increases with an increase of the input impedance at a given reception energy, so that the communication sensitivity, maximum communication distance and other communication characteristics of the RFID tag 12 will be improved with the increase of the input impedance.

There will next be described in detail the radio communication of the radio-frequency tag communication device 14 with the RFID tag 12. FIG. 14 indicates a plurality of commands used for the radio communication of the radio-frequency tag communication device 14 with the RFID tag 12. The communication to identify the desired RFID tag 12 uses commands such as "PING" and "SCROLL ID" for reading out the information stored in the RFID tag 12. The communication to write the information on the RFID tag 12 uses commands such as "ERASE ID" for initializing the information stored in the RFID tag 12, "PROGRAM ID" for information writing, "VERIFY" for verifying the information written, and "LOCK" for inhibiting writing of new information.

Figure 15:
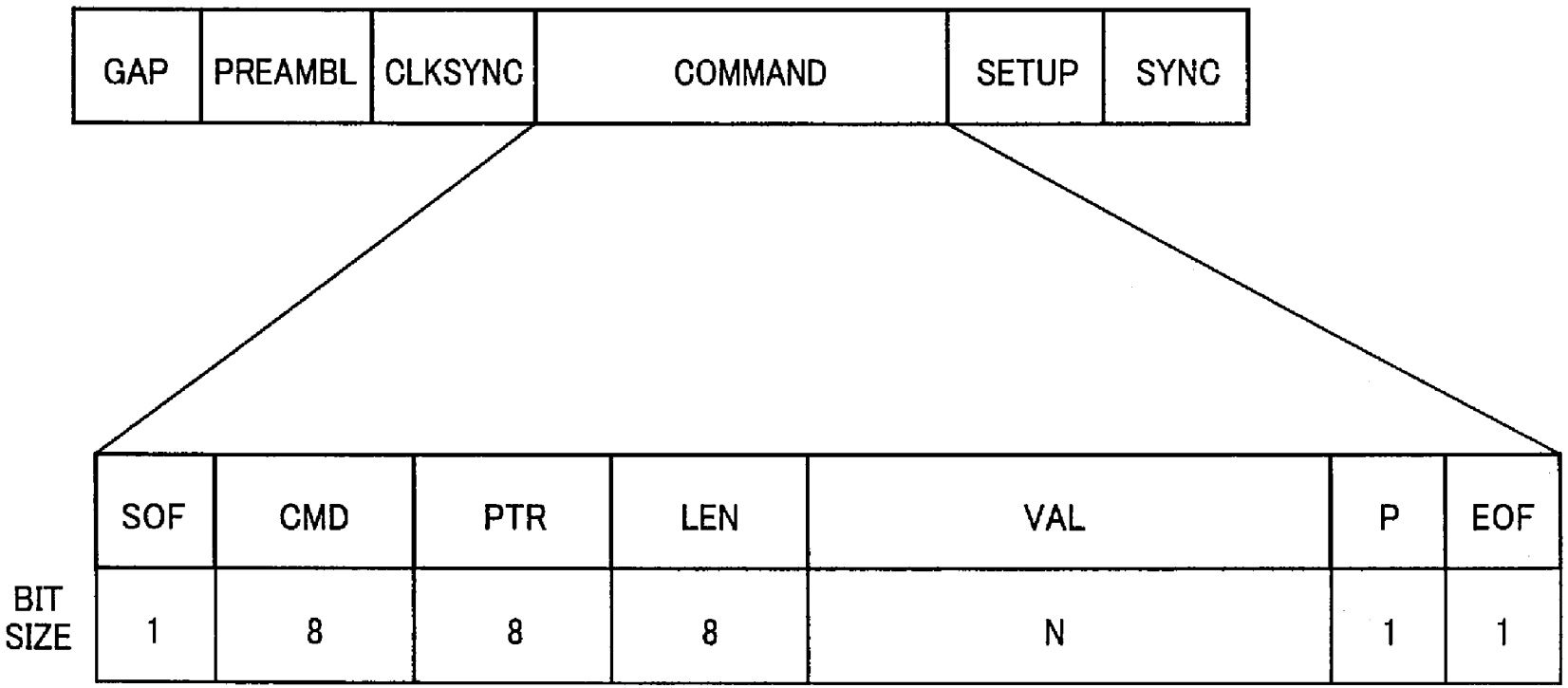
FIG. 15 is a view showing in detail a structure of a command frame generated by the radio-frequency tag communication device of FIG. 2.

Referring to FIG. 15, there will be described in detail a structure of the command frame generated by the radio-frequency tag communication device 14. The above-described command frame uses unit time $T_0$ for transmission of one-bit information, and consists of "GAP" which is a $2T_0$ transmission power-off period, "PREAMBL" which is a $5T_0$ transmission power-on period, "CLKSYNC" for transmission of twenty "0" signals, "COMMAND" which are the contents of the commands, "SET UP" which is a $8T_0$ transmission power-on period, and "SYNC" for transmission of one "1" signal. The "COMMAND" which is interpreted by the RFID tag 12 consists of "SOP" indicating the start of the commands, "CMD" which are the commands indicated in FIG. 14, "PTR" which is a pointer specifying the memory address of the selected or desired RFID tag 12, "LEN" which indicates the length of the information to be written, "VAL" which is the content of information to be written, "P" which is parity information of "PTR", "LEN" and "VAL", and "EOF" which indicates the end of the commands.

Figure 16:
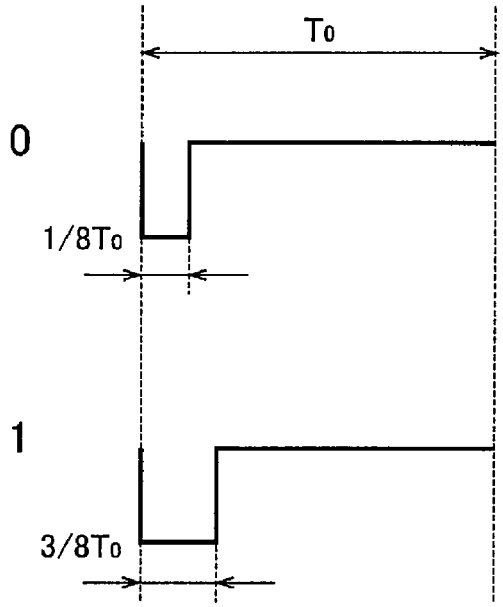
FIG. 16 is a view illustrating "0" signal and "1" signal which are elements of the command frame of FIG. 15.

The command frame described above is a series of elements consisting of the "0" and "1" signals indicated in FIG. 16, and the transmission power-on and power-off periods. For the operation to identify the desired RFID tag 12, or the operation to write the information on the RFID tag 12, the modulating information on the basis of the command frame is generated by the command-bit-string generating portion 32 of the radio-frequency tag communication device 14, encoded by the FM-encoding portion 34, modulated by the AM modulating portion 36, and transmitted through the transmitter/receiver antenna 24 toward the RFID tag 12. The RFID tag 12 which receives the modulated information performs the information writing on the memory portion 62 and information replying operation, according to the commands.

Figure 17:
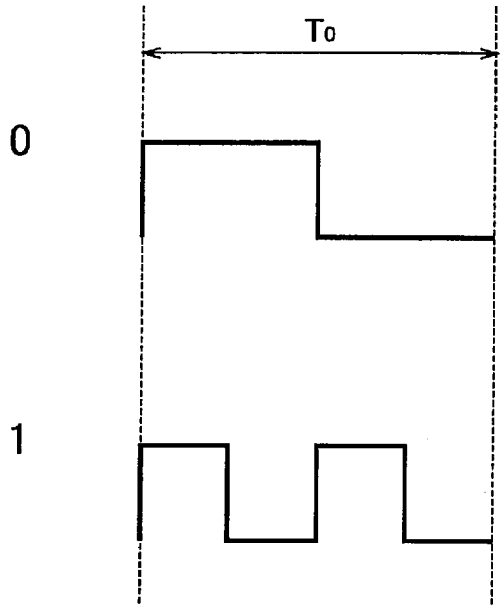
FIG. 17 is a view illustrating "0" signal and "1" signal used for generation of a reply signal transmitted from the radio-frequency identification tag of FIG. 3.
Figure 18:
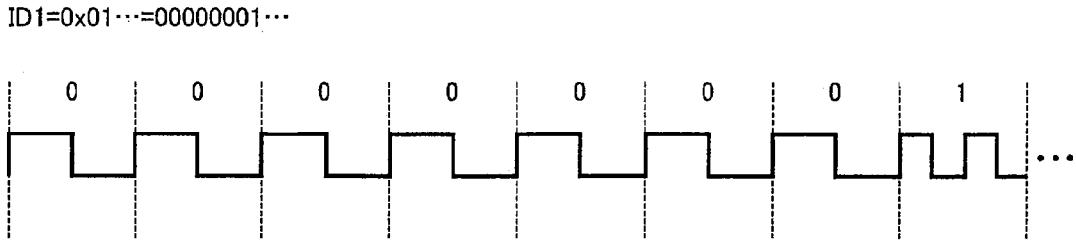
FIG. 18 is a view illustrating an example of an ID signal specific to the radio-frequency identification tag of FIG. 3.

In the information replying operation of the RFID tag 12, reply information discussed below in detail is constituted by a series of elements consisting of FM-encoded "0" and "1" signals indicated in FIG. 17. On the basis of these signals, the carrier wave is reflection-modulated, and transmitted to the radio-frequency tag communication device 14. In the operation to identify the desired RFID tag 12, for instance, a reflected wave modulated according to an ID signal specific to the RFID tag 12, which is shown in FIG. 18 is transmitted to the radio-frequency tag communication device 14.

Figure 19:
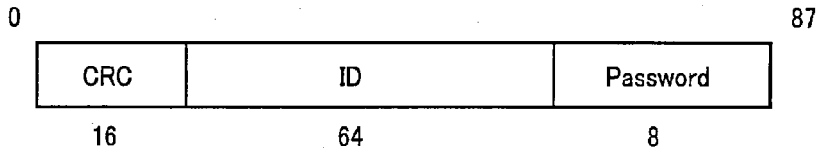
FIG. 19 is a view illustrating a memory structure of the radio-frequency identification tag of FIG. 3.
Figure 20:
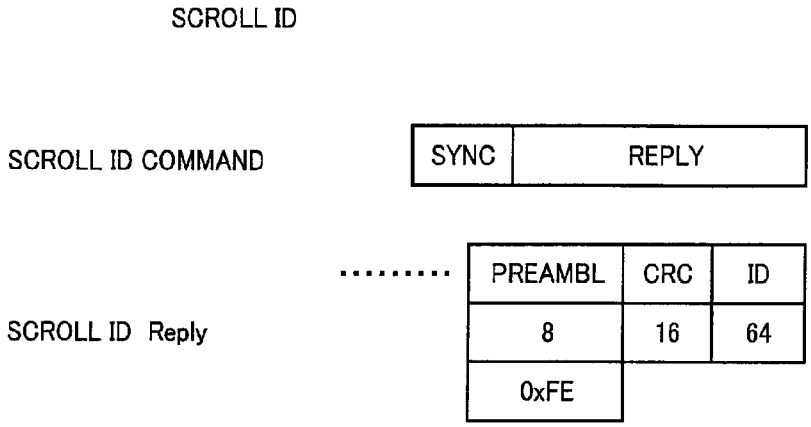
FIG. 20 is a view for explaining "SCROLL ID Reply" transmitted in response to a signal including a "SCROLL ID" command, when the signal is received by the radio-frequency identification tag of FIG. 3.

Referring to FIG. 19, there will be described an arrangement of the memory of the RFID tag 12. As shown in FIG. 19, the memory portion 62 of the RFID tag 12 stores a result of calculation of the CRC sign value, the ID specific to the RFID tag 12, and a password. When a signal including the "SCROLL ID" command as shown in FIG. 20 is received, the generated reply signal consists of the 8-bit "PREAMBL" signal represented by OxFE, "CRC" representing the result of calculation of the CRC sign value stored in the memory portion 62, and the "ID" identifying the desired RFID tag 12.

Figure 21:
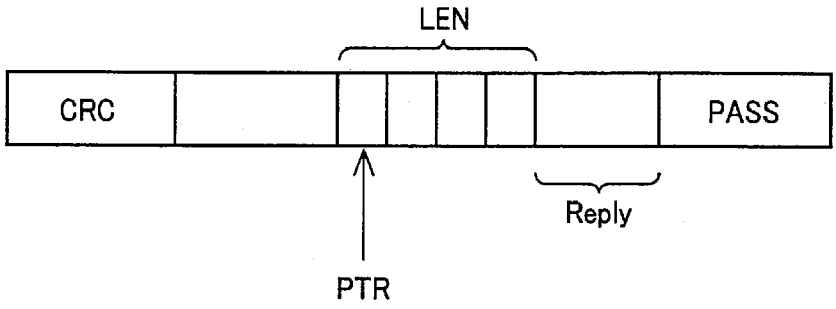
FIG. 21 is a view for explaining extraction of information following "LEN" which is a part of the information stored in a memory portion shown in FIG. 3.
Figure 22:
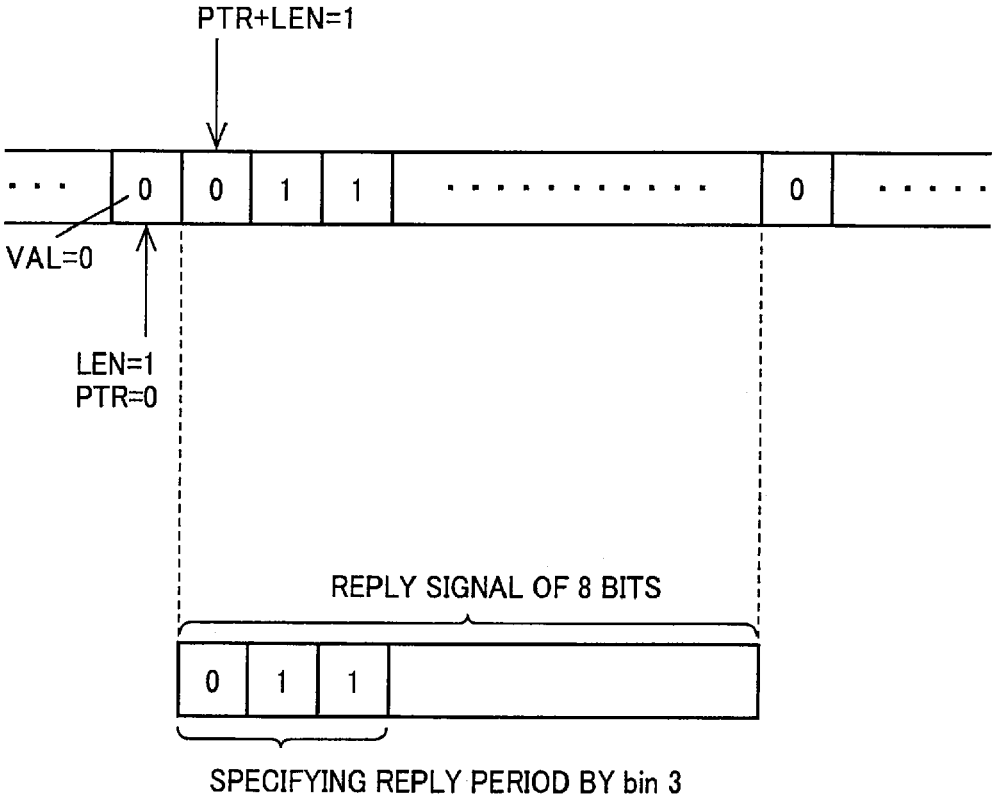
FIG. 22 is a view showing in detail the "SCROLLED ID Reply" of FIG. 20.

The above-described "PING" command of FIG. 14 is used to read out information stored in the memory portion 62 of each of the plurality of RFID tags 12, which information corresponds to the "CRC" and "ID", that is, to specify the reading start position. As shown in FIG. 21, the "PING" command includes the start address pointer "PTR", the data length "LEN", and the value "VAL. Where the number of data sets stored in the memory portion 62, which number is represented by the data length "LEN" as counted from the address represented by the pointer "PTR", is equal to a value represented by the value "VAL", as indicated in FIG. 22, the reply signal consists of 8-bit data sets following the address (PTR+LEN+1). If the number of the data sets stored in the memory portion 72 as represented by the data length "LEN" as counted from the address represented by the pointer "PTR" is not equal to the value represented by the value "VAL", the reply signal is not generated.

Figure 23:
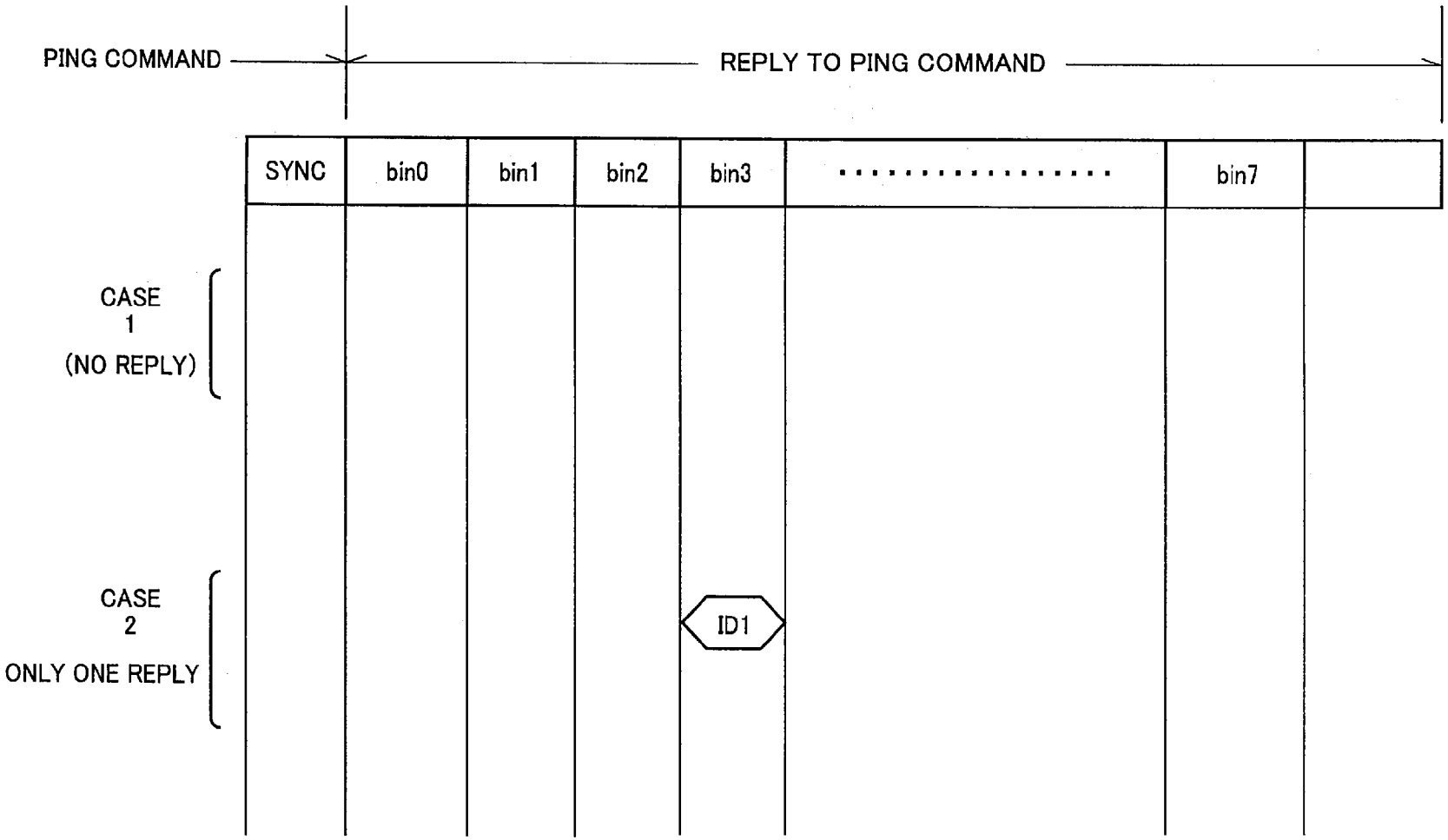
FIG. 23 is a view indicating an example of a reply from a radio-frequency identification tag, which possibly takes place when the radio-frequency tag communication device of FIG. 2 operates to identify the radio-frequency identification tags located within an area of possible radio communication.

The timing at which the RFID tag 12 replies to the "PING" command is determined by upper three bits of the reply signal. That is, the reply signal is transmitted during one of periods "bin0" through "bin7" separated from each other by "BIN" pulses transmitted from the radio-frequency tag communication device 14, following the "PING" command. Where the "PIN" command includes "PTR=0", "LEN=1" and "VAL=0", for example, the RFID tag 12 wherein the first bit stored in the memory portion 62 is equal to "0 " represented by the value "VAL" extracts a signal as shown in FIG. 22, and incorporates this signal into the reply signal. Where the upper three bits of the reply signal are "0", "1" and "1", the reply signal is transmitted in response to the "PING" command, during a reply period "bin3" as indicated in FIG. 23.

Figure 24:
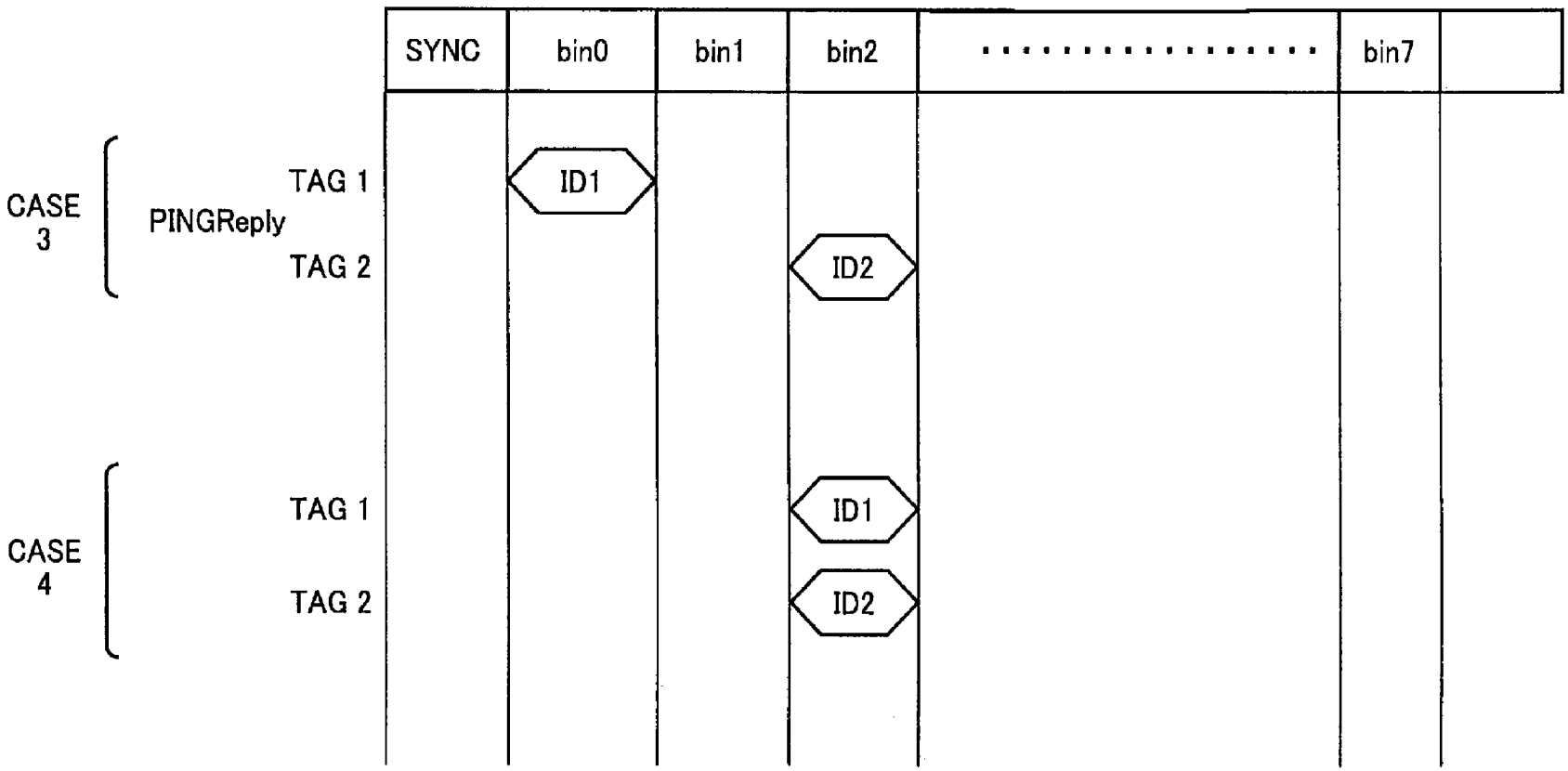
FIG. 24 is a view indicating another example of a reply from a radio-frequency identification tag, which possibly takes place when the radio-frequency tag communication device of FIG. 2 operates to identify the RFID tags located within the area of possible radio communication.

The reply to the "PING" command differs depending upon the number of the tags, as described below. That is, where any RFID tag 12 is present within the communication area of the radio-frequency tag communication device 14, no reply is transmitted, as in CASE 1 of FIG. 23. Where one RFID tag 12 is present within the communication area, the reply signal indicating "ID1" is transmitted during the period "bin3", for example, as in CASE 2 of FIG. 23. Where two RFID tags 12 are present within the communication area, the reply signal indicating "ID1" is transmitted during a period "bin0", for example, while the reply signal indicating "ID2" is transmitted during a period "bin2", for example, as in CASE 3 of FIG. 24. Where two RFID tags 12 are present within the communication area, the reply signal indicating "ID1" and the reply signal indicating "ID2" are transmitted during the period "bin2", for example, as in CASE 4 of FIG. 24, if the value of the upper three bits of ID1 and that of the upper three bits of ID2 are equal to each other. The number of the RFID tags 12 within the communication area and the ID of each of the RFID tags 12 can be obtained by repetition of the "PING" command after changing "PTR", "LEN" and "VAL". By using the obtained ID, the information writing on the desired RFID tag 12 can be effected.

The antenna 52 constructed according to the present embodiment of the invention includes the driven meander line portion 72 which has the feed sections ES connected to the IC circuit portion 54 and which is a line conductor formed in a meandering pattern, and the parasitic meander line portion 74 which does not have a feed section connected to the IC circuit portion 54 and which is a line conductor formed in a meandering pattern and positioned relative to the driven meander line portion 72, so as to influence the input impedance of the driven meander line portion 72. Accordingly, the input impedance of the driven meander line portion 72 can be made close to the input impedance of the IC circuit portion 54, by suitably positioning the driven and parasitic meander line portions 72, 74. Accordingly, the RFID tag 12 provided with the antenna 52 can be small-sized, with a minimum matching loss of the input impedance of the driven meander line portion 72 with that of the IC circuit portion 54, and with minimum deterioration of the communication characteristics of the antenna 52 such as the communication sensitivity and maximum communication distance. That is, the present embodiment provides the small-sized antenna 52 which has a good impedance match with the IC circuit portion 54 and which maintains the desired communication characteristics.

The present embodiment is further arranged such that the parasitic meander line portion 74 is electrically insulated from said driven meander line portion 72. Where the parasitic meander line portion 74 is positioned relatively close to the driven meander line portion 72, the input impedance of the driven meander line portion 72 can be stably and suitably influenced by the parasitic meander line portion 74.

The present embodiment is further arranged such that each of the driven and parasitic meandering portions 72, 74 includes the plurality of transverse conductive sections 76 and a plurality of longitudinal conductive sections 80 which are alternately arranged in the longitudinal direction of the antenna 52, and are alternately connected to each other so as to form the meandering pattern, such that the distances in the longitudinal direction between one of the transverse conductive sections 76 of the driven meander line portion 72 and the two transverse conductive sections 76 adjacent to the above-indicated one transverse conductive section 76 are respectively different from the distances in the longitudinal direction between one of the transverse conductive sections 80 of the parasitic meander line portion 74 and the two transverse conductive sections 80 adjacent to the above-indicated one transverse conductive section 80 of the parasitic meander line portion 74, in at least a part of the length of the meandering pattern in the longitudinal direction of the antenna 52. In this case, the driven and parasitic meander lines portions 72, 74 can be formed in the same plane, so that the total surface area occupied by those two meander line portions 72, 74 can be reduced.

The present embodiment is further arranged such that the driven and parasitic meander line portions 72, 75 are positioned relative to each other so as to define the plurality of first portions 90 and the plurality of second portions 92 which are arranged at the predetermined pitch in the predetermined positional relationship with each other in the longitudinal direction of the antenna 52, such that the center-to-center distance between the adjacent two transverse conductive sections 80 of the parasitic meander line portion 74 in each first part 90 minus the width dimensions of the above-indicated adjacent two transverse conductive sections 80 is larger than a sum of a center-to-center distance between the adjacent two transverse conductive sections 76 of the driven meander line portion 72 and the width dimensions of the adjacent two transverse conductive sections 76 of the driven meander line portion 72, and such that a sum of the center-to-center distance between the adjacent two transverse conductive sections 80 of the parasitic meander line portion in each second part 92 and the width dimensions of the adjacent two transverse conductive sections 80 of the parasitic meander line portion 74 is smaller than the center-to-center distance between the adjacent two transverse conductive sections 76 of the driven meander line portion 72 minus the width dimensions of the adjacent two transverse conductive sections 76 of the driven meander line portion 72. In this case, the surface area required for the driven and parasitic meander line portions 72, 74 can be reduced while assuring a high degree of communication sensitivity and a sufficient maximum distance of communication of the RFID tag 12 provided with the antenna 52.

The present embodiment is further arranged such that the driven meander line portion 72 and the parasitic meander line portion 74 are formed in the same plane. In this case, the driven and parasitic meander line portions 72, 74 need not be superposed on each other, so that the antenna 52 and the RFID tag 12 provided with the antenna 52 can be easily small-sized, and the costs of manufacture of those devices 52, 12 can be effectively reduced.

The present embodiment is further arranged such that the driven and parasitic meander line portions 72, 74 have the plurality of second parts 92 in each of which the adjacent two transverse conductive sections 80 of the parasitic meander line portion 74 are interposed between the corresponding adjacent two transverse conductive sections 76 of the driven meander line portion 72 in the longitudinal direction of the antenna 52. In this arrangement, the adjacent two transverse conductive sections 76 of the driven meander line portion 72 are interposed between the corresponding adjacent two transverse conductive sections 80 of the parasitic meander line portion 74, in the plurality of first parts 90 corresponding to the above-described plurality of second parts 92. The mutual interposition of the driven and parasitic meander line portions 72, 74 permits effective reduction of the surface area required for the driven and parasitic meander line portions 72, 74, while assuring a high degree of communication sensitivity and a sufficient maximum distance of communication of the RFID tag 12 provided with the antenna 52.

In the present embodiment, the plurality of second parts 92 in each of which the adjacent two transverse conductive sections 80 of the parasitic meander line portion 74 are interposed between the corresponding adjacent two transverse conductive sections 76 of the driven meander line portion 72 are located close to the IC circuit portion 54. In this case, the adjacent two transverse conductive sections 76 of the driven meander line portion 72 are interposed between the corresponding adjacent two transverse conductive sections 80 of the parasitic meander line portion 74, in the plurality of first parts 90 located close to the circuit portion, so that the surface area required for the driven and parasitic meander line portions can be reduced while assuring the high degree of communication sensitivity and the sufficient maximum distance of communication of the RFID tag 12 provided with the antenna 52.

The present embodiment is further arranged such that the plurality of first parts 90 and the plurality of second parts 92 are arranged over the entire dimension of the meandering patterns of the driven and parasitic meander line portions 72, 74 in the longitudinal direction of the antenna 52. Accordingly, the surface area required for the driven and parasitic meander line portions 72, 74 can be reduced while assuring the high degree of communication sensitivity and the sufficient maximum distance of communication of the RFID tag 12 provided with the antenna 52.

In the present embodiment, the adjacent two transverse conductive sections 80 of the parasitic meander line portion 74 preferably are located nearer to one of the corresponding adjacent two transverse conductive sections 76 of the driven meander line portion 72 between which the adjacent two transverse conductive sections 80 are interposed. In this case, the driven and parasitic meander line portions 72, 74 are positioned relative to each other, so as to maximize the input impedance of the driven meander line portion 72, so that the surface area required for the driven and parasitic meander line portions 72, 74 can be reduced while assuring the high degree of communication sensitivity and the sufficient maximum distance of communication of the RFID tag 12 provided with the antenna 52.

The present embodiment is further arranged such that the total dimension of the plurality of longitudinal conductive sections 78.82, 84 of each of the driven and parasitic meander line portions 72, 74 in the longitudinal direction of the antenna 52 is larger than the length of the longest one of the plurality of transverse conductive sections 76, 80 in the transverse direction perpendicular to the longitudinal direction. This arrangement of the driven and parasitic meander line portions 72, 74 makes it possible to effectively reduce the surface area required for the driven and parasitic meander line portions 72, 74 while assuring the high degree of communication sensitivity and the sufficient maximum distance of communication of the device provided with the antenna.

The present embodiment is further arranged such that the driven and parasitic meander line portions 72, 74 have the respective different conductive path lengths. Accordingly, the input impedance of the driven meander line portion 72 can be easily matched with that of the IC circuit portion 54, by suitably adjusting the conductive path lengths.

The present embodiment is further arranged such that the antenna 52 has the plurality of resonant frequency values at which the imaginary component of the input impedance is zero, and the antenna 52 is operable at the frequency not lower than the second resonant frequency which is the second lowest of the plurality of resonant frequency values. Accordingly, the input impedance of the driven meander line portion 72 can be suitably matched with that of the input impedance of the IC circuit portion 54.

In the present embodiment, the feed sections ES of the driven meander line portion 72 which is connected to the IC circuit portion 54 is provided in one of the plurality of longitudinal conductive sections 78 of the driven meander line portion 72. In this case, the input impedance of the power-supply meandering portion 72 can be suitably matched with that of the IC circuit portion 54.

Further, the RFID tag 12 for radio communication with the radio-frequency tag communication device 14 includes the RFID tag 12 which has the antenna 52 constructed according to the present embodiment. In this RFID tag 12, the IC circuit portion 54 has the memory portion 62 for storing predetermined information. In the RFID tag 12, the input impedance of the driven meander line portion 72 of the antenna 52 can be made close to the input impedance of the IC circuit portion 54, by suitably positioning the driven and parasitic meander line portions 72, 74. Accordingly, the RFID tag 12 provided with the antenna 54 can be small-sized, with a minimum matching loss of the input impedance of the driven meander line portion 72 with that of the IC circuit portion 54, and with minimum deterioration of communication characteristics of the antenna 52 such as communication sensitivity and maximum communication distance. That is, the present embodiment a small-sized radio-frequency tag which has a good impedance match with the IC circuit portion 54 and which maintains desired communication characteristics.

The present embodiment is further arranged such that each of the driven meander line portion 72 and the parasitic meander line portion 74 has the conductive path length which is at least ½ of the wavelength of the electromagnetic wave used for the radio communication with the radio-frequency tag communication device 14. Accordingly, the RFID tag 12 provided with the driven and parasitic meander line portions 72, 74 can be small-sized while maintaining desired communication characteristics such as high communication sensitivity and sufficient maximum communication distance.

There will be described other embodiments of this invention. In the following embodiments, the same reference signs as used in the first embodiment will be used to identify the same elements, which will not be described redundantly.

Figure 25:
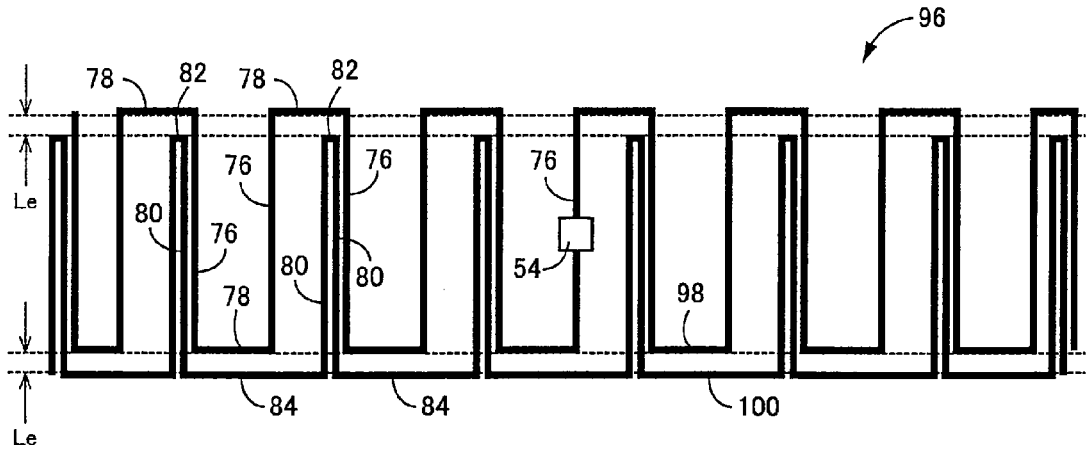
FIG. 25 is a plan view showing an arrangement of an antenna constructed according to another embodiment of this invention.

Referring to the plan view of FIG. 25, there is shown an arrangement of an antenna 96 constructed according to the second embodiment of this invention. Like the antenna 52 described above, this antenna 96 includes a driven meander line portion 98 and a parasitic meander line portion 100. The driven meander line portion 98 consists of the transverse conductive sections 76 and the longitudinal conductive sections 78 which are alternately connected to each other, so as to form a meandering or serpentine pattern, while the parasitic meander line portion 100 consists of the transverse conductive sections 80 and the longitudinal conductive sections 82, 84 which are alternately connected to each other so as to form a meandering or serpentine pattern. The driven and parasitic meander line portions 98, 100 are positioned relative to each other such that the adjacent two transverse conductive sections 80 of the parasitic meander line portion 100 which are spaced apart from each other by a comparatively small distance in the longitudinal direction are interposed between the corresponding adjacent two transverse conductive sections 76 of the driven meander line portion 98, while the adjacent two transverse conductive sections 76 are interposed between the corresponding adjacent two transverse conductive sections 80. The antenna 96 has a longitudinal dimension of about 67.5 mm, and a width or transverse dimension of about 18 mm. One of the adjacent two transverse conductive sections 80 which are spaced apart from each other by the comparatively small distance is located nearer to the adjacent transverse conductive section 76. This transverse conductive section 80 and the adjacent transverse conductive section 76 has a small distance of about 0.5 mm therebetween. However, this distance assures electrical insulation of the parasitic meander line portion 100 from the driven meander line portion 98. The upper longitudinal conductive sections 78 and the upper longitudinal conductive sections 82 as seen in FIG. 25 are spaced apart from each other by a distance Le of about 2.0 mm in the width or transverse direction of the antenna 96, while the lower longitudinal conductive sections 78 and the lower longitudinal conductive sections 84 are spaced apart from each other by the same distance Le. In the present antenna 96, the IC circuit portion 54 is connected to one of the transverse conductive sections 76 of the driven meander line portion 98, which is located at a central position in the longitudinal direction of the antenna 96. Namely, this central longitudinal conductive portion 76 has feed sections connected to the IC circuit portion 54. Thus, the driven and parasitic meander line portions 98, 100 and the IC circuit portion 54 constitute the RFID tag 12 in which the IC circuit portion 54 is spaced from the parasitic meander line portion 100 by a relatively large distance. The RFID tag 12 formed on the above-described substrate 68 is capable of effecting radio communication with the radio-frequency tag communication device 14 described above.

Figure 26:
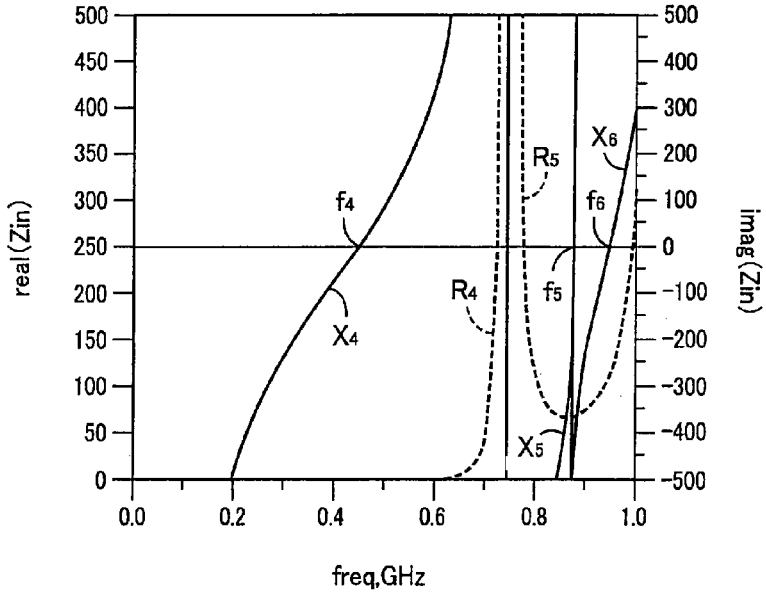
FIG. 26 is a view for explaining an input impedance of the antenna of a radio-frequency identification tag of FIG. 25, wherein solid line curves represent resonant frequency while broken line curves represent a resistance (radiation resistance)

Like FIG. 11, FIG. 26 explains the input impedance of the antenna 96. In FIG. 26, solid line curves represent an imaginary component of the input impedance, that is, an admittance, while broken line curves represent a resistance (radiation resistance. Regarding the curves representative of the series resonant frequency, the resistance represented by the curve $R_4$ corresponding to the curve $X_4$ representative of the lowest first resonant frequency is substantially zero at the frequency $f_4$ in the neighborhood of 500 MHz at which the imaginary component of the series resonant frequency is zero. In this case, the antenna 96 is not operable in a satisfactory manner. In the case of the curve $X_2$ representative of the second lowest resonant frequency, which is almost parallel to the vertical axis, like the curves representative of the parallel resonant frequency, an amount of change of the admittance component with the frequency is excessively large, so that the antenna 96 is not operable in a satisfactory manner, either. However, the resistance represented by the curve $R_5$ corresponding to the curve $X_6$ representative of the third lowest third resonant frequency is about 110Ω at the frequency $f_6$ in the neighborhood of 960 MHz at which the imaginary component of the series resonant frequency is zero. In this case, the antenna 96 has an input impedance high enough to permit the antenna 96 to be operated in a satisfactory manner. Further, the resistance represented by the curve $R_3$ corresponding to the curve $X_3$ representative of the third lowest third resonant frequency is about 230Ω at the frequency $f_3$ in the neighborhood of 980 MHz at which the imaginary component of the series resonant frequency is zero. In this case, too, the antenna 52 has an input impedance high enough to permit the antenna 52 to be operated in a satisfactory manner. Thus, the antenna 96 according to the present second embodiment has a plurality of resonant frequency values at which the imaginary component of the input impedance is zero. Accordingly, the antenna 96 of the RFID tag 12 can function in the intended manner, at the third and subsequent resonant frequency values.

In the second embodiment described above, the feed section of the driven meander line portion 98 which is connected to the IC circuit portion 54 is provided in one of the plurality of transverse conductive sections 76 of the driven meander line portion 98. In this case, the IC circuit portion 54 can be connected to the feed section at a central part of the substrate 68 as seen in the transverse direction of the substrate 68, so that the IC circuit portion 54 can be positioned within the width of the substrate 68, whereby the antenna 96 and the RFID tag 12 provided with the antenna 96 can be effectively small-sized.

Figure 27:
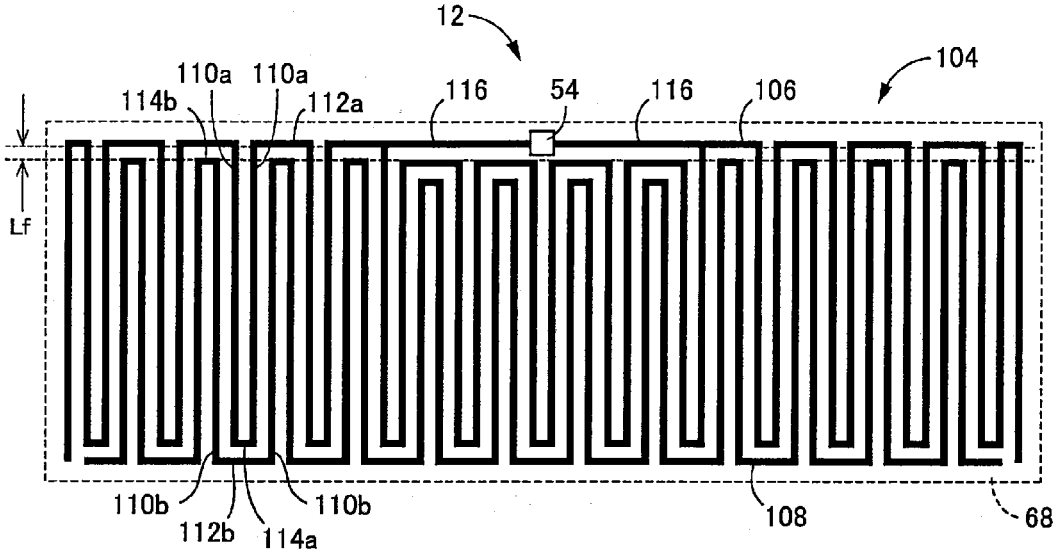
FIG. 27 is a view showing an arrangement of an antenna constructed according to a further embodiment of this invention.

Referring next to the plan view of FIG. 27, there is shown an arrangement of an antenna 104 constructed according to the third embodiment of this invention. This antenna 104 includes a driven meander line portion 106 which is a line conductor formed in a meandering pattern, and a parasitic meander line portion 108 which is also a line conductor formed in a meandering pattern. Each of the driven and parasitic meander line portions 106, 108 consists of a plurality of transverse conductive sections 110, a plurality of long longitudinal conductive sections 112 and a plurality of short longitudinal conductive sections 114. The transverse conductive sections 110 and the longitudinal conductive sections 112, 114 are alternately connected to each other, so as to form a meandering or serpentine pattern. As shown in FIG. 27, the adjacent two transverse conductive sections 110 of the parasitic meander line portion 108 are interposed between the corresponding adjacent two transverse conductive sections 110 of the driven meander line portion 106, over the entire length of the substrate 68, while at the same time the adjacent two transverse conductive sections 110 of the driven meander line portion 106 are interposed between the corresponding adjacent two transverse conductive sections 110 of the parasitic meander line portion 108, over the entire length of the substrate 68. Further, the corresponding ends of the long and short longitudinal conductive sections 112, 114 have a predetermined constant distance Lf of about 1.0 mm, on each of the upper and lower sides of the substrate 68 as seen in FIG. 27. The driven meander line portion 106 is formed such that a ratio of two distances between one of the transverse conductive sections 110*a* and the respective two transverse conductive sections 110 adjacent to said one transverse conductive section 110*a* is 1; 3, while the parasitic meander line portion 108 is formed such that a ratio of two distances between one of the transverse conductive sections 110*b* and the respective two transverse conductive sections 110*b* adjacent to said one transverse conductive section 110*b* is 3:1. The present antenna 104 further includes a pair of feed line sections 116 which are line conductors connected to the IC circuit portion 54 and the driven meander line portion 106. That is, the IC circuit portion 54 is connected to the driven meander line portion 106 through the feed line sections 116. Like the transverse conductive sections 110 and longitudinal conductive sections 112, the feed line sections 116 are thin strips or bands of a suitable electrically conductive material such as copper, aluminum and silver, which has a width of about 0.5 mm and a thickness of about 16 μm and which are formed by a suitable forming technique such as a metal-foil or thin-film forming process, or a printing process (using a paste of silver or copper, for example). In longitudinal parts of the driven and parasitic meander line portions 106, 108, which longitudinal parts correspond to the feed line sections 116, the lengths of the transverse conductive sections 110*a*, 110*b* are made shorter than those of the other transverse conductive sections 110*a*, 110*b*, by an amount equal to the distance Lf indicated above. Thus, the RFID tag 12 is constituted by forming on the substrate 68 the driven and parasitic meandering portions 106, 108, feed line sections 116 and IC circuit portion 54, such that the feed line sections 116 are aligned with the longitudinal conductive sections 112*a* in the above-indicated longitudinal part of the driven meander line portion 106, while the IC circuit portion 54 is located near one of the opposite transverse or width ends of the substrate 68, so that the IC circuit portion 54 and feed line sections 116 are located close to a substantially rectangular area in which the driven and parasitic meander line portions 106, 108 are formed.

In the present third embodiment, the antenna 104 comprises the feed line sections 116 each of which is a line conductor, and the feed section of the driven meander line portion 106 which is connected to the IC circuit portion 54 is connected to the feed line sections 116. Accordingly, the driven meander line portion 106 is connected to the IC circuit portion 54 through the feed line sections 116 having a suitable length, so that IC circuit portion 54 can be short-circuited via the feed line sections 116 and the driven meander line portion 106, whereby electrostatic breakage of the IC circuit portion 54 can be effectively prevented.

Since the. IC circuit portion 54 is located near one of the opposite transverse ends of the antenna 104, the meander line portions 106, 108 can be formed over a relatively large surface area on the substrate 68.

Figure 28:
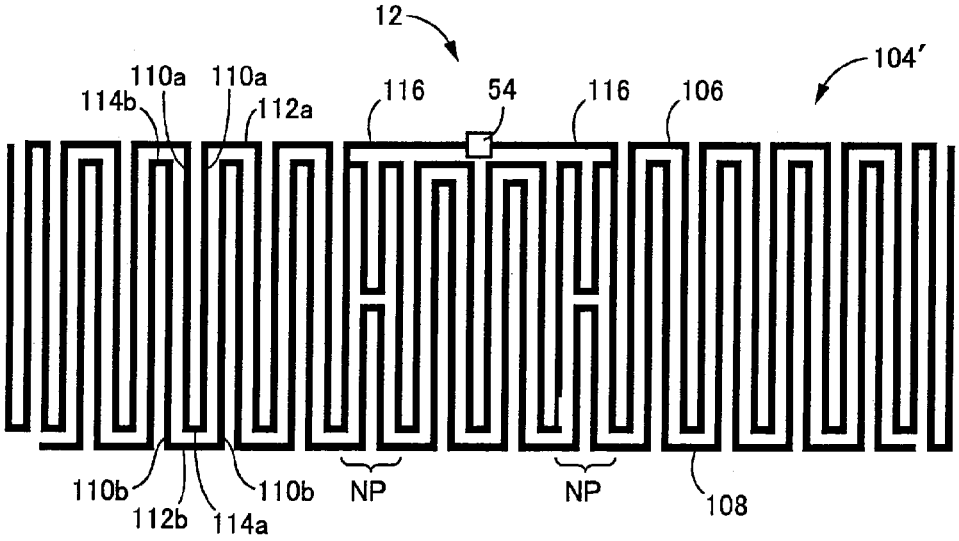
FIG. 28 is a view showing an arrangement of an antenna constructed according to a still further embodiment of the invention.

Referring next to the plan view of FIG. 28. there is shown an arrangement of an antenna 104' according to the fourth embodiment of this invention, which is a modification of the antenna 104. In the antenna 104, the adjacent two transverse conductive sections 110*a* of the driven meander line portion 106 are interposed between the corresponding adjacent two transverse conductive sections 110*b* of the parasitic meander line portion 108, while the adjacent two transverse conductive sections 110*b* are interposed between the corresponding adjacent two transverse conductive sections 110*a*, over the entire length of the substrate 68. In the antenna 104', however, the driven and parasitic meander line portions 106, 108 have non-interposition parts NP in which the adjacent two transverse conductive sections 110*a* are not interposed between the corresponding adjacent transverse conductive sections 110*b*, and the adjacent two transverse conductive sections 110*b* are not interposed between the corresponding adjacent two transverse conductive sections 110*a*. In this fourth embodiment, too, the parasitic meander line portion 108 is formed so as to influence the input impedance of the driven meander line portion 106. That is, the present embodiment provides the small-sized antenna 104' and RFID tag 12 which have a good impedance match with the IC circuit portion 54 and which maintain the desired communication characteristics.

Figure 29:
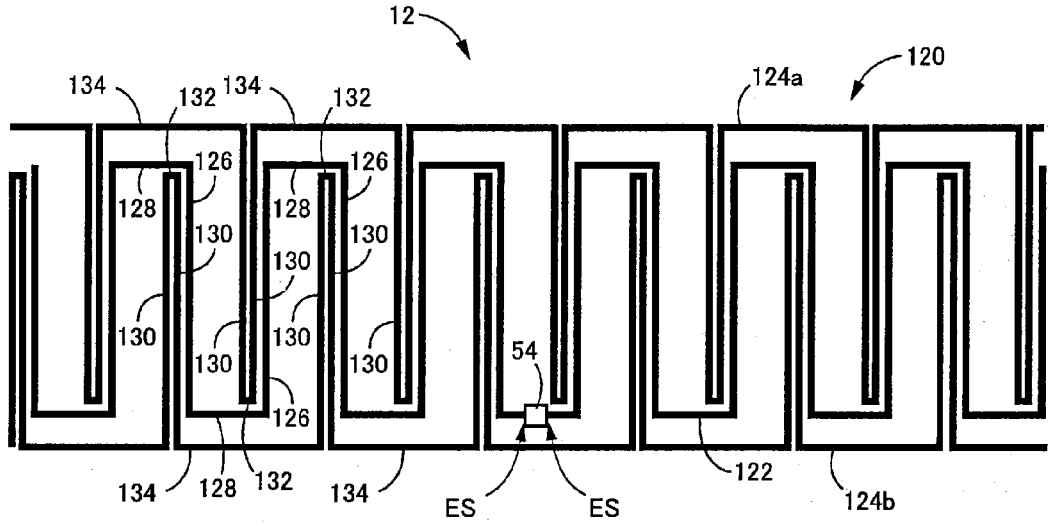
FIG. 29 is a view showing an arrangement of an antenna constructed according to a yet further embodiment of the invention.

The plan view of FIG. 29 shows an arrangement of an antenna 120 according to the fifth embodiment of the invention, which consists of a driven meander line portion 122, and a pair of parasitic meander line portions 124*a*, 124*b* (hereinafter collectively referred to as "parasitic meander line portions 124", unless otherwise specified). The driven meander line portion 122 is a line conductor which is formed in a meandering pattern and which has feed sections ES connected to the IC circuit portion 54. The parasitic meander line portions 124 are line conductors not having the feed sections ES, which line conductors are formed in a meandering pattern and located so as to influence the input impedance of the driven meander line portion 122. The driven meander line portion 122 includes a plurality of transverse conductive sections 126 and a plurality of longitudinal conductive sections 128, which are alternately arranged and connected to each other in the longitudinal direction of the antenna 120, so as to form the meandering pattern. Each of the two parasitic meander line portion 124 includes a plurality of transverse conductive sections 130, a plurality of short longitudinal conductive sections 132, and a plurality of long longitudinal conductive sections 134, which are alternately arranged and connected to each other in the longitudinal direction of the antenna 120, so as to form the meandering pattern. The adjacent two transverse conductive sections 130 of the parasitic meander line portion 124*a* are interposed between the corresponding adjacent two transverse conductive sections 126 of the driven meander line portion 122, while the adjacent two transverse conductive sections 126 are interposed between the corresponding adjacent two transverse conductive sections 130, over the entire length of the antenna 120. A relative position of the driven meander line portion 122 and the parasitic meander line portion 124*a* is similar to the relative position between the driven and parasitic meander line portions 72, 74 of the antenna 52 described above. A relative position between the driven meander line portion 122 and the parasitic meander line portion 124*b* is symmetrical with that between the line portions 122, 124*a*, with respect to a straight line. This antenna 120 has a comparatively strong resonance, and the relative positions of the driven and parasitic meander line portions 122, 124*a*, 124*b* permit the antenna 120 to exhibits various characteristics. In the antenna 120, one of the longitudinal conductive sections 128 of the driven meander line portion 122 which is located at a central position in the longitudinal direction of the antenna 120 has feed sections ES connected to the IC circuit portion 54, and the RFID tag 12 is constituted by the meander line portions 122, 124 and the IC circuit portion 54. The present embodiment provides the small-sized antenna 120 and RFID tag 12 which have a good impedance match with the IC circuit portion 54 and which maintain the desired communication characteristics.

Figure 30:
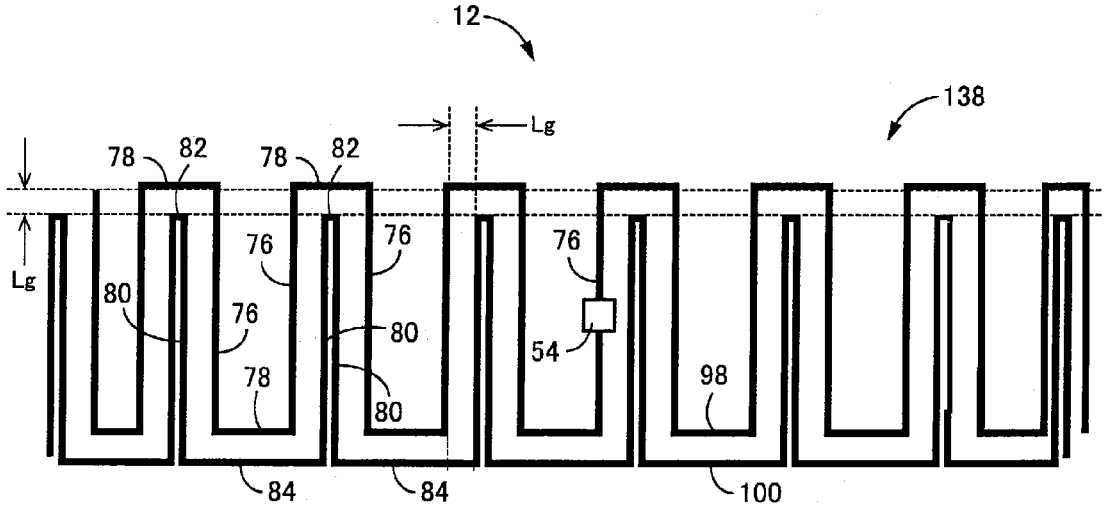
FIG. 30 is a view showing an arrangement of an antenna constructed according to another embodiment of the present invention.

Referring to the plan view of FIG. 30, there is shown an arrangement of an antenna 130 according to the sixth embodiment of this invention, which consists of the above-described driven and parasitic meander line portions 98, 100. However, these meander line portions 98, 100 are positioned relative to each other such that the adjacent two transverse conductive sections 80 of the parasitic meander line portion 100 which are spaced apart from each other by the comparatively small distance are spaced apart from the corresponding adjacent two transverse conductive sections 76 of the driven meander line portion 98 by the same distance Lg, in at least a longitudinal part of the antenna 138 which is relatively near the IC circuit portion 54. Further, the distance between the upper end of the longitudinal conductive sections 78 of the driven meander line portion 98 and the upper end of the longitudinal conductive sections 82, 84 of the parasitic meander line portion 100, and the distance between the lower ends of the longitudinal conductive sections 78 and the longitudinal conductive sections 82, 84 are equal to the above-indicated distance Lg. In this antenna 138, the central transverse conductive section 76 as seen in the longitudinal direction is connected to the IC circuit portion 54, and the RFID tag 12 is constituted by the meander line portions 89, 100 and the IC circuit portion 54. The present embodiment provides the small-sized antenna 138 and RFID tag 12 which have a good impedance match with the IC circuit portion 54 and which maintain the desired communication characteristics.

Figure 31:
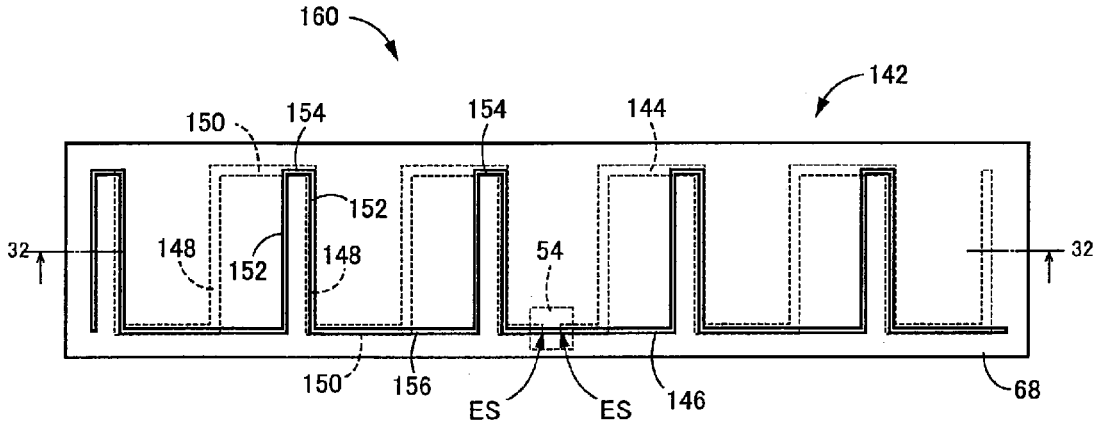
FIG. 31 is a view showing an arrangement of an antenna constructed according to a further embodiment of the invention.
Figure 32:
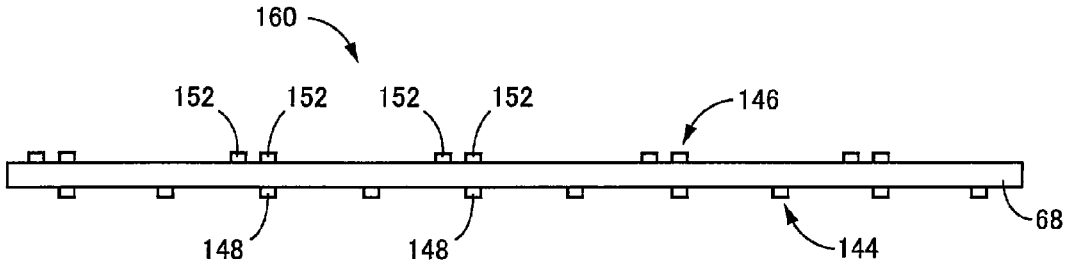
FIG. 32 is a cross sectional view taken along line 32-32 of FIG. 31.

The plan view of FIG. 31 shows an arrangement of an antenna 142 according to the seventh embodiment of the invention. FIG. 32 is a cross sectional view taken along line 32-32 of FIG. 31. As shown in these figures, the antenna 142 consists of a driven meander line portion 144, and a parasitic meander line portion 146. The driven meander line portion 144 is a line conductor which is formed in a meandering pattern and which has feed sections ES connected to the IC circuit portion 54. The parasitic meander line portion 146 is a line conductor which is formed in a meandering pattern so as to influence the input impedance of the driven meander line portion 144 and which does not have feed sections ES. As shown in FIG. 32, the driven and parasitic meander line portions 144, 146 are formed in respective two different planes on the substrate 68, namely, on the respective back and front surfaces of the substrate 68 by a suitable process such as metal-foil, thin-film or printing process, such that the IC circuit portion 54 is connected to the driven meander line portion 144.

The driven meander line portion 144 includes a plurality of transverse conductive sections 148 and a plurality of longitudinal conductive sections 150, which are alternately arranged and connected to each other in the longitudinal direction of the antenna 142, so as to form the meandering pattern. The parasitic meander line portion 146 includes a plurality of transverse conductive sections 152, a plurality of short longitudinal conductive sections 154, and a plurality of long longitudinal conductive sections 156, which are alternately arranged and connected to each other, so as to form the meandering pattern. The transverse conductive sections 148 of the driven meander line portion 144 and the transverse conductive sections 152 of the parasitic meander line portion 146 have substantially the same length, and are formed so as to overlap each other as viewed in a plane parallel to the front and back surfaces of the substrate 68, as shown in FIG. 32. In this antenna 142, the centrally located longitudinal conductive section 150 of the driven meander line portion 144 as seen in the longitudinal direction is connected to the IC circuit portion 54, and a radio-frequency tag 160 is constituted by the IC circuit portion 54 and the meander line portions 144, 146 which are formed on the substrate 68. Like the RFID tag 12, the radio-frequency tag 160 is capable of effecting radio communication with the radio-frequency tag communication device 14. The present embodiment provides the small-sized antenna 142 and RFID tag 160 which have a good impedance match with the IC circuit portion 54 and which maintain good communication characteristics.

Figure 33:
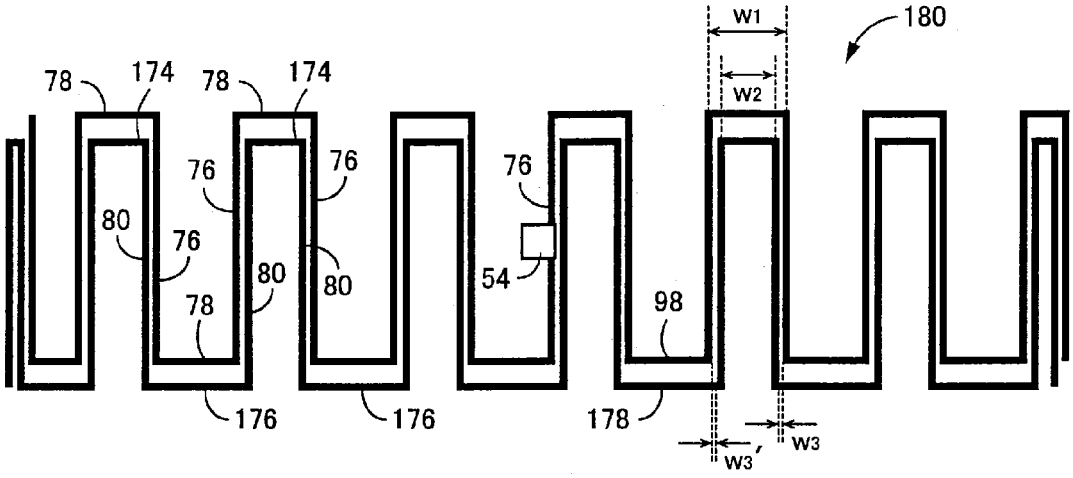
FIG. 33 is a view showing an arrangement of an antenna constructed according to a still further embodiment of the invention.

Referring further to the plan view of FIG. 33, there is shown an arrangement of an antenna 180 according to the eighth embodiment of the present invention, which consists of the above-described driven meander line portion 98 including the transverse and longitudinal conductive sections 76, 78 alternately connected to each other, and a parasitic meander line portion 178 including the above-described transverse conductive sections 80, short longitudinal conductive sections 174 and long longitudinal conductive sections 176 which are alternately connected to each other so as to form a meandering pattern. As in the antenna 52 described above with respect to the first embodiment, the adjacent two transverse conductive sections 80 of the parasitic meander line portion 178 are interposed between the corresponding adjacent two transverse conductive sections 76 of the driven meander line portion 98, while the adjacent two transverse conductive sections 76 are interposed between the corresponding adjacent two transverse conductive sections 80, over the entire length of the antenna 180. The longitudinal conductive sections 174 provided in the antenna 180 correspond to the longitudinal conductive sections 82 provided in the antenna 52, and have a length smaller than that of the longitudinal conductive sections 78 of the driven meander line portion 98 (larger than that of the longitudinal conductive sections 82 of the parasitic meander line portion 74). The longitudinal conductive sections 176 correspond to the longitudinal conductive sections 84 of the antenna 52, and have a length larger than that of the longitudinal conductive sections 78 of the driven meander line portion 98 (shorter than that of the longitudinal conductive sections 84).

In the present antenna 180, a distance w1 indicated in FIG. 33, that is, a center-to-center distance between the adjacent two transverse conductive sections 76 of the driven meander line portion 98 is about 5 mm, and a distance w2 indicated in FIG. 33, that is, a center-to-center distance between the adjacent two transverse conductive sections 80 of the parasitic meander line portion 178 is about 3 mm, while distances w3 and w3' indicated in FIG. 33, that is, gap distances between the adjacent two transverse conductive sections 80 interposed between the corresponding adjacent two transverse conductive sections 76 is about 0.25-0.5 mm. Namely, the center-to-center distance w2 between the adjacent two transverse conductive sections 80 of the parasitic meander line portion 178 is not shorter than a half of the distance w1 between the corresponding adjacent two transverse conductive sections 76 of the driven meander line portion 76 between which the adjacent two transverse conductive sections 80 are interposed. Further, the gap distances w3, w3' between the adjacent two transverse conductive sections 80 and the respective adjacent two transverse conductive sections 76 between which the adjacent two transverse conductive sections 80 are interposed are not larger than a width (0.1-3.0 mm) of the transverse conductive sections 76, 80. Further, the total length of the driven meander line portion 98 is about 306 mm, while the total length of the parasitic meander line portion 178 is about 315 mm. Although both of the gap distances w3 and w3' are not larger than the width of the transverse conductive sections 76, 80 in the antenna 180, only one of the gap distances w3 and w3' may be determined to be not larger than the width of the transverse conductive sections 76, 80. In the present antenna 180, too, the centrally located transverse conductive sections 76 of the driven meander line portion 98 as seen in the longitudinal direction is connected to the IC circuit portion 54, and an RFID tag is constituted by the IC circuit portion 54 and the meander line portions 98, 178 which are formed on the substrate. Like the RFID tag 12, this RFID tag is capable of effecting radio communication with the radio-frequency tag communication device 14.

Figure 34:
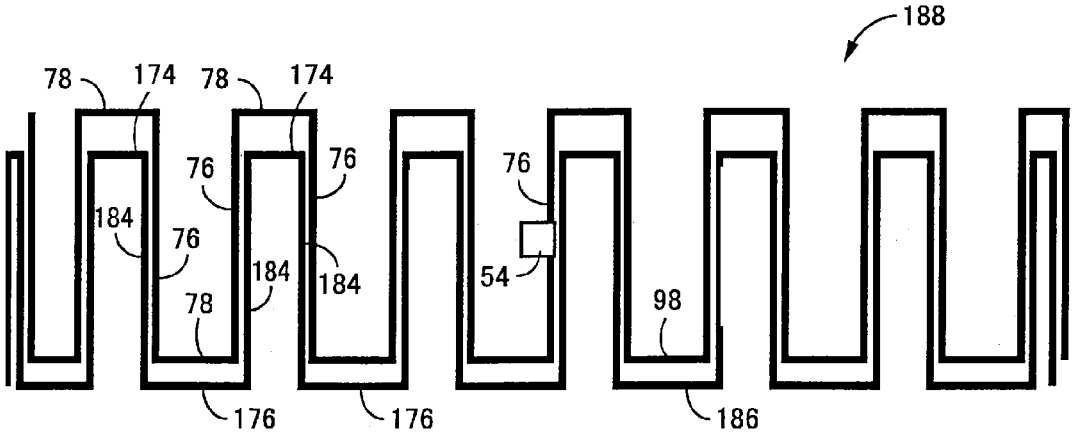
FIG. 34 is a view showing an arrangement of an antenna constructed according to a yet further embodiment of the invention.

The plan view of FIG. 34 shows an arrangement of an antenna 188 according to the ninth embodiment of the invention. This antenna 188 includes a parasitic meander line portion 186 having transverse conductive sections 184 which are slightly shorter than the transverse conductive sections 80 of the parasitic meander line portion 178 of the antenna 180 of FIG. 33. In the other aspects, the antenna 188 is identical with the antenna 180. The parasitic meander line portion 186 has a total length of about 306 mm, which is almost equal to the total length of the driven meander line portion 98. The IC circuit portion 54 is connected to one of the transverse conductive portions 76 which is located at a central position of the antenna 188 as seen in the longitudinal direction. Thus, an RFID tag similar to the RFID tag 12 is constituted by the IC circuit portion 54 and the driven and parasitic meander line portions 98, 186, which are formed on the substrate. The thus formed radio-frequency tag is capable of effecting radio communication with the radio-frequency tag communication device 14.

Figure 35:
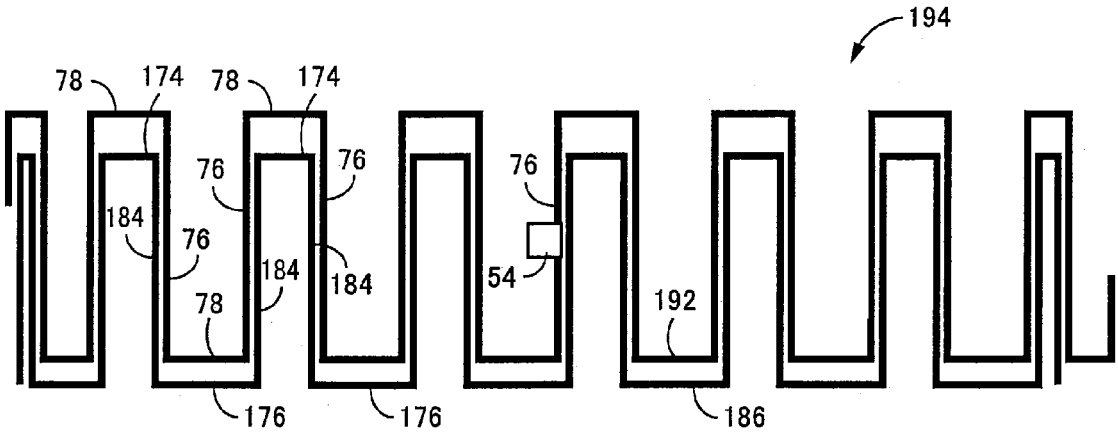
FIG. 35 is a view showing an arrangement of an antenna constructed according to a further embodiment of the invention.

Referring to the plan view of FIG. 35, there is shown an arrangement of an antenna 194 according to the tenth embodiment of this invention, which includes a driven meander line portion 192 having a larger total length than the driven meander line portion 98 of the antenna 188 of FIG. 34. In the other aspects, the antenna 194 is identical with the antenna 188 of FIG. 34. The parasitic meander line portion 186 has a total length of about 322 mm, which is larger than the total length of the parasitic meander line portion 186. The IC circuit portion 54 is connected to one of the transverse conductive portions 76 which is located at a central position of the antenna 194 as seen in the longitudinal direction. Thus, an RFID tag similar to the RFID tag 12 is constituted by the IC circuit portion 54 and the driven and parasitic meander line portions 192, 186, which are formed on the substrate. The thus formed radio-frequency tag is capable of effecting radio communication with the radio-frequency tag communication device 14.

Figure 36:
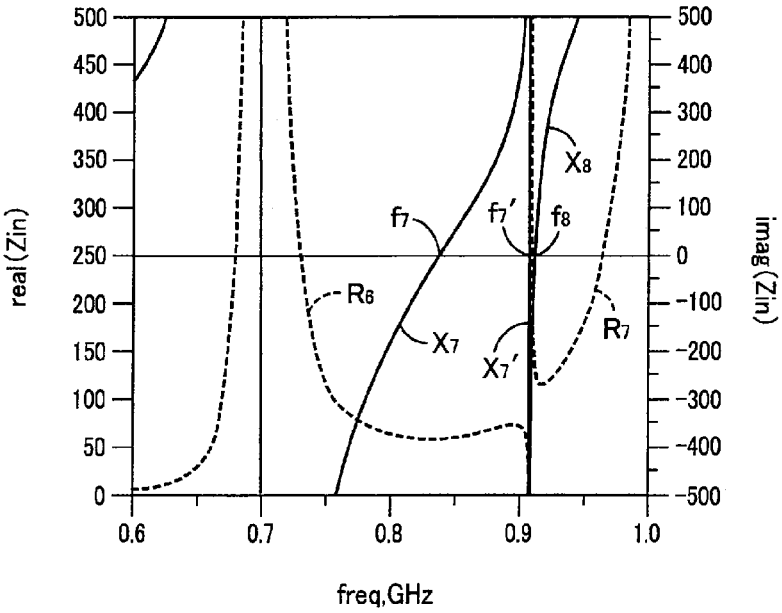
FIG. 36 is a view for explaining an input impedance of the antenna of the radio-frequency identification tag of FIG. 33, wherein solid line curves represent resonant frequency while broken line curves represent a resistance (radiation resistance)

FIG. 36 corresponding FIG. 11 explains the input impedance of the antenna 180 shown in FIG. 33. In FIG. 36, solid line curves represent an imaginary component of the input impedance, that is, an admittance, while broken line curves represent a resistance (radiation resistance). Regarding the curves representative of the series resonant frequency, the imaginary component represented by a curve representative of the lowest first resonant frequency is zero at the frequency fi in the neighborhood of 500 MHz, as in the case of FIG. 11, and the corresponding resistance is substantially zero. In this case, the antenna 180 is not operable in a satisfactory manner. However, the resistance represented by a curve $R_6$ corresponding to a curve $X_7$ representative of the second lowest resonant frequency is about 60Ω at the frequency $f_7$ in the neighborhood of 839 MHz at which the imaginary component of the series resonant frequency is zero. In this case, the antenna 180 has an input impedance high enough to permit the antenna 180 to be operated in a satisfactory manner. In the case of a curve $X_8$ representative of the third lowest third resonant frequency, which is almost parallel to the vertical axis, an amount of change of the admittance component with the frequency is excessively large, so that the antenna 180 is not operable in a satisfactory manner, at a frequency $f_8$ at which the imaginary component represented by the curve $X_8$ is zero (and an amount of change of the resistance represented by the corresponding curve $R_7$ is also excessively large). Thus, the antenna 180 according to the eighth embodiment has a plurality of resonant frequency values at which the imaginary component of the input impedance is zero. Accordingly, the antenna 180 of the RFID tag can function in the intended manner, at the second and subsequent resonant frequency values. In addition, as indicated in FIG. 6, there is a comparatively large difference between the frequency $f_7$ at which the imaginary component represented by the curve $X_7$ representative of the second lowest resonant frequency is zero, and a frequency $f_7'$ at which at which the imaginary component represented by a curve $X_7'$ representative of the parallel resonant frequency higher than the second lowest resonant frequency is maximum. Although the imaginary component changes from plus infinity to minus infinity, the imaginary component is represented by the curve $X_7'$ which passes the parallel resonant frequency $f_7'$, for convenience sake. Accordingly, there exists a broad frequency band between the frequency values $f_7$ and $F_7'$. In the frequency in the neighborhood of the second resonant frequency, the resistance component of the input impedance is held substantially constant at about 60-70Ω, so that the antenna 180 exhibits stable characteristics.

Figure 37:
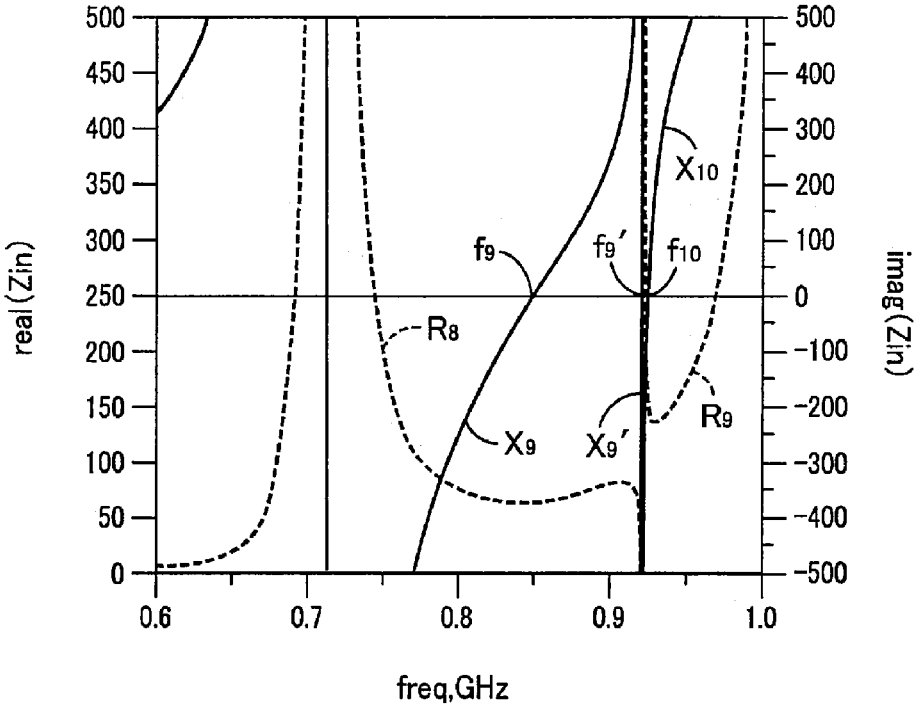
FIG. 37 is a view for explaining an input impedance of the antenna of the radio-frequency identification tag of FIG. 34, wherein solid line curves represent resonant frequency while broken line curves represent a resistance (radiation resistance)

FIG. 37 also corresponding to FIG. 11 explains the input impedance of the antenna 188 shown in FIG. 34. In FIG. 37, solid line curves represent the imaginary component of the input impedance, that is, the admittance, while broken line curves represent the resistance (radiation resistance). It is noted that the input impedance of the antenna 194 shown in FIG. 35 is almost the same as that of the antenna 188. Regarding the curves in FIG. 37 representative of the series resonant frequency, the imaginary component represented by a curve representative of the lowest first resonant frequency is zero at the frequency $f_1$ in the neighborhood of 500 MHz, as in the case of FIG. 11, and the corresponding resistance is substantially zero. In this case, the antenna 188 is not operable in a satisfactory manner. However, the resistance represented by a curve $R_8$ corresponding to a curve $X_8$ representative of the second lowest resonant frequency is about 65Ω at the frequency $f_7$ in the neighborhood of 849 MHz at which the imaginary component of the series resonant frequency is zero. In this case, the antenna 188 has an input impedance high enough to permit the antenna 188 to be operated in a satisfactory manner. In the case of a curve $X_{10}$ representative of the third lowest third resonant frequency, which is almost parallel to the vertical axis, an amount of change of the admittance component with the frequency is excessively large, so that the antenna 188 is not operable in a satisfactory manner, at a frequency $f_{10}$ at which the imaginary component represented by the curve $X_{10}$ is zero (and an amount of change of the resistance represented by the corresponding curve $R_9$ is also excessively large). Thus, the antennas 188, 194 according to the ninth and tenth embodiments have a plurality of resonant frequency values at which the imaginary component of the input impedance is zero. Accordingly, the antennas 188, 194 can function in the intended manner, at the second and subsequent resonant frequency values. In addition, as indicated in FIG. 37, there is a comparatively large difference between the frequency $f_9$ at which the imaginary component represented by the curve $X_9$ representative of the second lowest resonant frequency is zero, and a frequency $f_9'$ at which at which the imaginary component represented by a curve $X_9'$ representative of the parallel resonant frequency higher than the second lowest resonant frequency is zero. Accordingly, there exists a broad frequency band between the frequency values $f_7$ and $F_7'$. In the frequency in the neighborhood of the second resonant frequency, the resistance component of the input impedance is held substantially constant at about 65-75Ω, so that the antennas 188, 194 exhibit stable characteristics.

Figure 38:
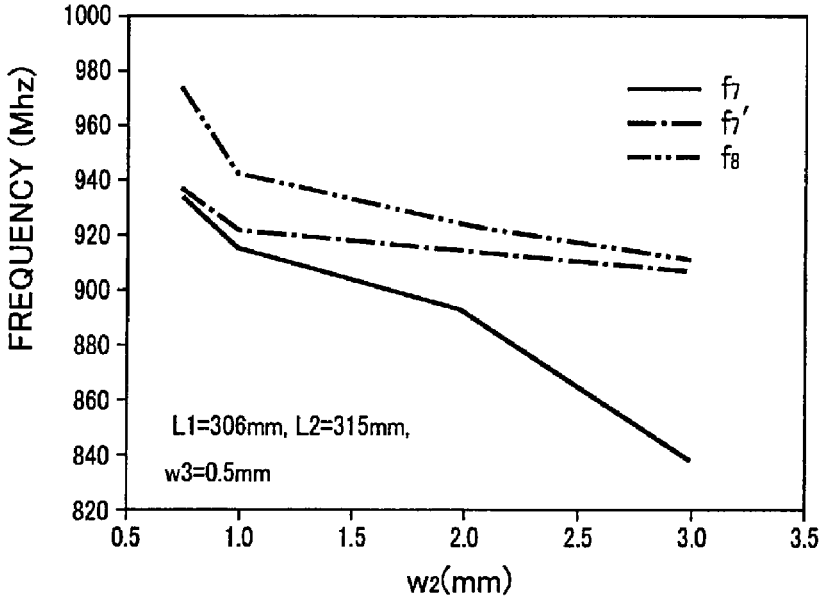
FIG. 38 is a graph indicating changes of frequencies $f_7$, $f_7'$ and $f_8$ of FIG. 36, with a change of a distance $w_2$ in the antenna of FIG. 33.
Figure 39:
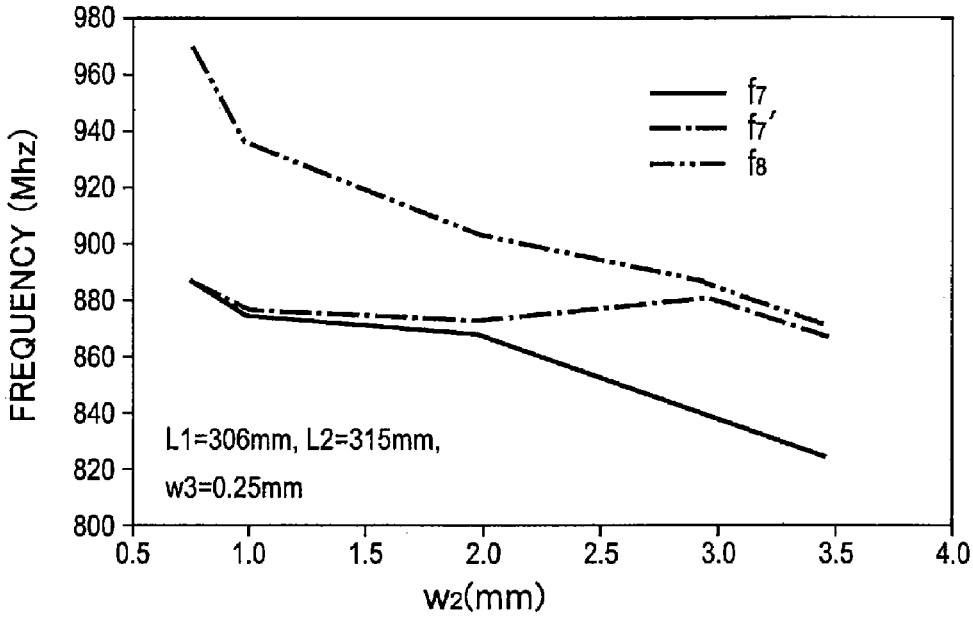
FIG. 39 is a graph indicating changes of the frequencies $f_7$, $f_7'$ and $f_8$ of FIG. 36, with a change of the distance $w_2$ in the antenna of FIG. 33.

FIGS. 38 and 39 are graphs indicating changes of the frequencies $f_7$, $f_7'$ and $f_8$ with a change of the center-to-center distance w2 shown in FIG. 33 between the adjacent two transverse conductive sections 80 of the parasitic meander line portion 178 in the antenna 180. The distance w2 shown in FIG. 33 is about 0.5 mm in the case of the graph of FIG. 38, and about 0.25 mm in the case of the graph of FIG. 39. It will be understood from these graphs that the frequency $f_7$ at which the imaginary component represented by the curve $X_7$ representative of the second lowest resonant frequency is zero decreases with an increase of the center-to-center distance w2. It will also be understood that the difference between the frequency $f_7$ and the frequency $f_7'$ at which the imaginary component represented by the curve $X_7'$ representative of the next parallel resonant frequency increases with the increase of the center-to-center distance w2. The frequency used by the antenna 180 is preferably as low as possible within a range in which the antenna 180 has a good impedance match with the IC circuit portion 54 and maintains desired communication characteristics. Further, the difference between the frequencies $f_7$ and $f_7'$ is preferably large. Therefore, the distance w2 is preferably at least 2.0 mm in the case of FIG. 38, and at least 2.5 mm in the case of FIG. 39, and more preferably at least 2.5 mm in both cases. Thus, the center-to-center distance w2 between the adjacent two transverse conductive sections 80 of the parasitic meander line portion 178 which are interposed between the corresponding adjacent two transverse conductive sections 76 of the driven meander line portion 98 is preferably at least ⅖, and more preferably ½ of the distance between those adjacent two transverse conductive sections 76 between which the adjacent two transverse conductive sections 80 are interposed. The center-to-center distance w2 thus determined permits improved stability of the communication characteristics and an increased band of the frequency of the antenna 180.

Figure 40:
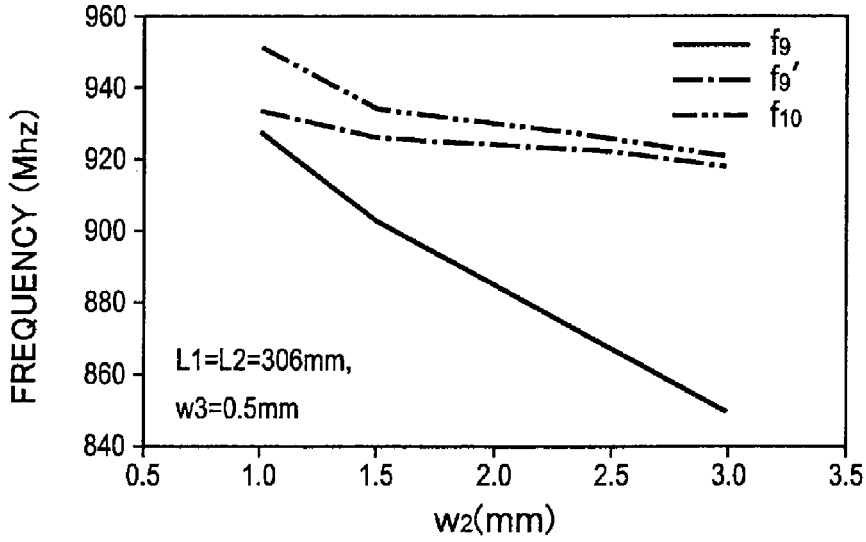
FIG. 40 is a graph indicating changes of frequencies $f_9$ $f_9'$ and $f_{10}$ of FIG. 37, with a change of the distance $w_2$ of FIG. 33, in the antenna of FIG. 34.
Figure 41:
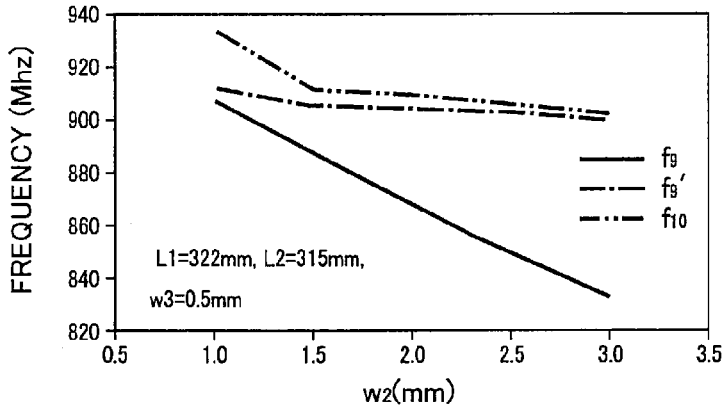
FIG. 41 is a graph indicating changes of the frequencies $f_9$ $f_9'$ and $f_{10}$ of FIG. 37, with a change of the distance $w_2$ of FIG. 33, in the antenna of FIG. 35.

FIGS. 40 and 41 are graphs indicating changes of the frequencies $f_9$, $f_9'$ and $f_{10}$ with a change of the center-to-center distance w2 (shown in FIG. 33) between the adjacent two transverse conductive sections 184 of the parasitic meander line portion 186 in the antennas 188, 194. The graphs of FIGS. 40 and 41 respective correspond to the antennas 188, 194 of FIGS. 34 and 35. It will be understood from these graphs that the frequency $f_9$ at which the imaginary component represented by the curve $X_9$ representative of the second lowest resonant frequency is zero decreases with an increase of the center-to-center distance w2. It will also be understood that the difference between the frequency $f_9$ and the frequency $f_9'$ at which the imaginary component represented by the curve $X_9'$ representative of the next parallel resonant frequency increases with the increase of the center-to-center distance w2. As in the case of the antenna 180 described above by reference to FIGS. 38 and 39, the distance w2 is preferably at least 2.0 mm, and more preferably at least 2.5 mm in both cases of FIGS. 34 and 35. Thus, the center-to-center distance w2 between the adjacent two transverse conductive sections 184 of the parasitic meander line portion 178 which are interposed between the corresponding adjacent two transverse conductive sections 76 of the driven meander line portion 98, 192 is preferably at least ⅖, and more preferably ½ of the distance between those adjacent two transverse conductive sections 76 between which the adjacent two transverse conductive sections 2184 are interposed. The center-to-center distance w2 thus determined permits improved stability of the communication characteristics and an increased band of the frequency of the antennas 188, 194.

In the eighth, ninth and tenth embodiments of FIGS. 33-35 described above, the center-to-center distance w2 between the adjacent two transverse conductive sections 80*m* 184 of the parasitic meander line portion 178. 186 which are interposed between the corresponding adjacent two transverse conductive sections 76 of the driven meander line portion 98, 192 is at least a half (½) of the center-to-center distance between those adjacent two transverse conductive sections 76 of the driven meander line portion 98, 192. Accordingly, the antennas 180, 188, 194 have a comparatively low series resonant frequency, and a comparatively large difference between the series resonant frequency and the next parallel resonant frequency. Further, the resistance component of the input impedance is held substantially constant at the frequency in the neighborhood of the series resonant frequency.

The eighth, ninth and tenth embodiments are further arranged such that at least the gap distance w3 between one of the adjacent two transverse conductive sections 80, 184 of the parasitic meander line portion 178, 186 which is nearer to the corresponding one of the adjacent two transverse conductive sections 76 of the driven meander line portion 98, 192 between which the adjacent two transverse conductive sections 80, 184 of the parasitic meander line portion 178, 186 are interposed is not larger than the width of the transverse conductive sections 76, 80, 194 of the driven and parasitic meander line portions 98, 178, 186, 192. Accordingly, the antennas 180, 188, 194 have a high degree of stability of its characteristics, and the frequency band as broad as possible.

The eighth, ninth and tenth embodiments are also arranged such that the gap distances w3, w3' between the respective adjacent two transverse conductive sections 80, 184 of the parasitic meander line portion 178, 186 which are interposed between the corresponding adjacent two transverse conductive sections 76 of the driven meander line portion 98, 192 are not larger than the width of the transverse conductive sections 76, 178, 186, 192 of the driven and parasitic meander line portions 98, 178, 186, 192. Accordingly, the antennas 180, 188, 193 have a higher degree of stability of its characteristics, and a broader frequency band.

The eighth, ninth and tenth embodiments are further arranged such that the antennas 180, 188, 194 have a plurality of resonant frequency values at which the imaginary component of its input impedance is zero, and are operable at the second lowest resonant frequency which is the second lowest of the above-indicated plurality of resonant frequency values. Accordingly, the input impedance of the driven meander line portion 98, 192 can be suitably matched with the input impedance of the IC circuit portion 54.

While the preferred embodiments of the present invention have been described in detail by reference to the drawings, for illustrative purpose only, it is to be understood that the present invention may be otherwise embodied.

Figure 42:
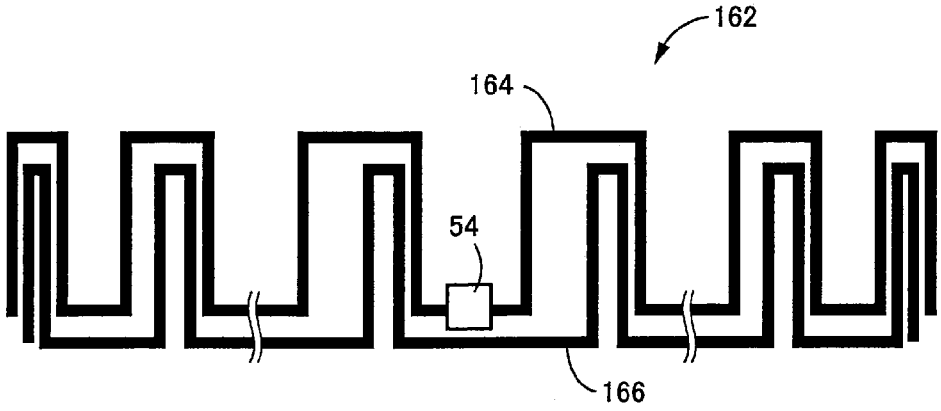
FIG. 42 is a plan view showing an arrangement of an antenna constructed according to another embodiment of this invention.
Figure 43:
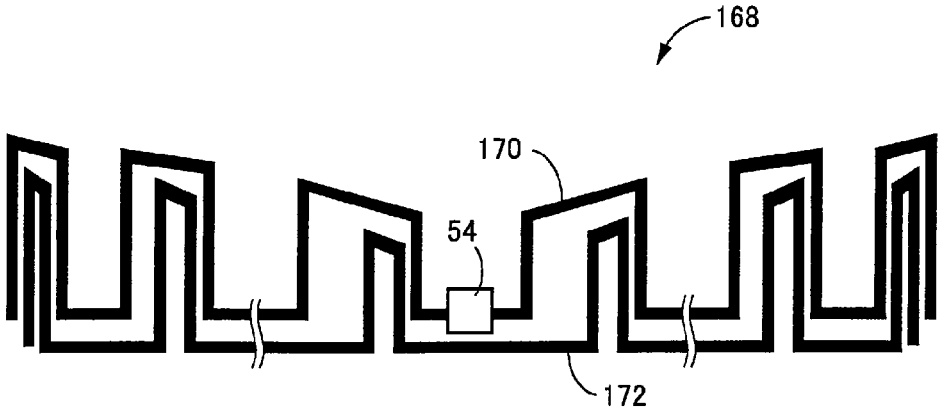
FIG. 43 is a plan view showing an arrangement of an antenna constructed according to a further embodiment of the invention.

In the preceding embodiments 52, 96, etc., the each of the driven and parasitic meander line portions is a succession of meander unit forms (unit patterns) arranged at a predetermined pitch in the longitudinal direction of the antenna. However, the pattern configuration of the driven and parasitic meander line portions may be modified as desired. FIGS. 42 and 43 show examples of such modifications according to further embodiments of this invention. In the example of FIG. 42, an antenna 162 consists of a driven meander line portion 166 and a parasitic meander line portion 168 each of which is a succession of rectangular unit forms wherein a distance between the adjacent two transverse conductive sections decreases with an increase of a distance of a pair of the adjacent two transverse conductive sections from the IC circuit portion 54 in the longitudinal direction of the antenna 162. In other words, the length of each longitudinal conductive section of the driven and parasitic meander line sections decreases with the increase of the distance of each pair of adjacent two transverse conductive sections. Further, a distance between one of the adjacent two transverse conductive sections of the parasitic meander line portion 166 interposed between the corresponding adjacent two transverse conductive sections of the driven meander line portion 164 and the corresponding transverse conductive section of the driven meander line portion 164 decreases with the increase of the distance of the above-indicated one transverse conductive section of the non-power-supply conductive section from the IC circuit portion 54 in the longitudinal direction of the antenna 162. In the example of FIG. 43, an antenna 168 consists of a driven meander line portion 170 and a parasitic meander line portion 172 each of which is a succession of non-rectangular unit forms wherein the length of each transverse conductive section decreases with an increase of the distance of the transverse conductive section from the IC circuit portion 54 in the longitudinal direction of the antenna 168, so that the upper longitudinal conductive sections as seen in FIG. 43 are inclined with respect to the lower longitudinal conductive sections. In these eleventh and twelfth embodiments, too, the antennas 162, 168 can be small-sized, while having a good impedance match with the IC circuit portion and maintain desired communication characteristics.

In the antenna 52, etc. according to the preceding embodiments, the adjacent two transverse conductive sections of the parasitic meander line portion 74, etc. are interposed between the corresponding adjacent two transverse conductive sections of the driven meander line portion 72, etc., while the adjacent two transverse conductive sections of the driven meander line portion 72, etc. are interposed between the corresponding adjacent two transverse conductive sections of the parasitic meander line portion 74, etc., over the entire length of the antenna 52, etc. However, the mutual interposition of the driven and parasitic meander line portions need not be present over the entire length of the antenna. The mutual interposition in a portion of the length of the antenna permits the parasitic meander line portion to influence the input impedance of the driven meander line portion. Further, the mutual interposition is not essential, provided the parasitic meander line portion is positioned relative to the driven meander line portion, so as to influence the input impedance of the driven meander line portion.

The RFID tag 12 described above with respect to the illustrated embodiments of the antenna is a passive type which is not provided with a power supply source but is supplied with an electric energy of the interrogating wave Fr received from the radio-frequency tag communication device 14. However, the radio-frequency tag provided with the antenna of the present invention may be an active type which is provided with a power supply source.

It is to be understood that various modifications not specifically described may be made to the eighth aspect of the invention, without departing from the spirit of the invention.

What is claimed is:

1. An antenna connected to a circuit portion and configured to effect transmission and reception of information by radio, communication, said antenna comprising:

a driven meander line portion comprising a plurality of driven meander line sections, wherein the driven meander line portion has a feed section connected to said circuit portion and which is a line conductor formed in a meandering pattern; and a parasitic meander line portion comprising a plurality of parasitic meander line sections, wherein the parasitic meander line portion does not have a feed section connected to said circuit portion and which is a line conductor formed in a meandering pattern, said parasitic meander line portion being positioned relative to said driven meander line portion, so as to influence an input impedance of said driven meander line portion, said parasitic meander line portion being electrically insulated from said driven meander line portion, each of said driven and parasitic meandering portions including a plurality of transverse conductive sections and a plurality of longitudinal conductive sections which are alternately arranged in a longitudinal direction of the antenna, and are alternately connected to each other so as to form the meandering pattern, said driven and parasitic meander line portions being positioned relative to each other so as to define a plurality of first portions and a plurality of second portions which are arranged at a predetermined pitch in a predetermined positional relationship with each other in said longitudinal direction, such that a center-to-center distance between the adjacent two transverse conductive sections of the parasitic meander line portion in each of said first portions minus width dimensions of said adjacent two transverse conductive sections is larger than a sum of a center-to-center distance between the adjacent two transverse conductive sections of the driven meander line portion and the width dimensions of the adjacent two transverse conductive sections of the driven meander line portion, and such that a sum of said center-to-center distance between the adjacent two transverse conductive sections of the parasitic meander line portion in each of said second portions and the width dimensions of the adjacent two transverse conductive sections of said parasitic meander line portion is smaller than said center-to-center distance between the adjacent two transverse conductive sections of the driven meander line portion minus the width dimensions of the adjacent two transverse conductive sections of the driven meander line portion, and said driven and parasitic meander line portions having at least one part in each of which the adjacent two transverse conductive sections of the parasitic meander line portion are interposed between the corresponding adjacent two transverse conductive sections of the driven meander line portion in said longitudinal direction.

2. The antenna according to claim 1, wherein said driven meander line portion and said parasitic meander line portion are formed in the same plane.

3. The antenna according to claim 1, wherein distances in said longitudinal direction between one of said transverse conductive sections of said driven meander line portion and the two transverse conductive sections adjacent to said one transverse conductive section are respectively different from distances in said longitudinal direction between one of said transverse conductive sections of said parasitic meander line portion and the two transverse conductive sections adjacent to said one transverse conductive section of the parasitic meander line portion, in at least a part of a length of said meandering pattern in said longitudinal direction.

4. The antenna according to claim 3, wherein a total dimension of said plurality of longitudinal conductive sections of each of said driven and parasitic meander line portions in said longitudinal direction is larger than a length of a longest one of said plurality of transverse conductive sections in a transverse direction perpendicular to said longitudinal direction.

5. The antenna according to claim 3, which has a plurality of resonant frequency values at which an imaginary component of its input impedance is zero, said antenna being operable at a second resonant frequency which is a second lowest of said plurality of resonant frequency values.

6. The antenna according to claim 3, wherein said feed section of the driven meander line portion which is connected to said circuit portion is provided in one of said plurality of longitudinal conductive sections of the driven meander line portion.

7. The antenna according to claim 3, wherein said feed section of the driven meander line portion which is connected to said circuit portion is provided in one of said plurality of transverse conductive sections of the driven meander line portion.

8. The antenna according to claim 3, further comprising a feed line section which is a line conductor, and wherein said feed section of the driven meander line portion which is connected to said circuit portion is connected to said feed line section.

9. The antenna according to claim 8, wherein said feed line section extends parallel to said longitudinal conductive sections, and said driven and parasitic meander line portions have longitudinal parts corresponding to said feed line section, said transverse conductive sections in said longitudinal part of the driven meander line portion have a length shorter than that of the transverse conductive sections in the other longitudinal part, and wherein the feed line section is aligned with the longitudinal conductive sections in said longitudinal part of the driven meander line portion.

10. The antenna according to claim 1, wherein said driven and parasitic meander line portions have a plurality of parts in each of which the adjacent two transverse conductive sections of the parasitic meander line portion are interposed between the corresponding adjacent two transverse conductive sections of the driven meander line portion in said longitudinal direction.

11. The antenna according to claim 10, wherein said plurality of parts are located close to said circuit portion.

12. The antenna according to claim 10, wherein said plurality of parts are arranged over an entire dimension of said meandering patterns of the driven and parasitic meander line portions in said longitudinal direction.

13. The antenna according to claim 1, wherein that the adjacent two transverse conductive sections of the parasitic meander line portion are located nearer to one of said corresponding adjacent two transverse conductive sections of the driven meander line portion between which the adjacent two transverse conductive sections of the parasitic meander line portion are interposed.

14. The antenna according to claim 1, wherein a center-to-center distance between the adjacent two transverse conductive sections of the parasitic meander line portion which are interposed between the corresponding adjacent two transverse conductive sections of the driven meander line portion is at least ½ of a center-to-center distance between said corresponding adjacent two transverse conductive sections of the driven meander line portion.

15. The antenna according to claim 1, wherein at least a gap distance between one of the adjacent two transverse conductive sections of the parasitic meander line portion which is nearer to the corresponding one of the adjacent two transverse conductive sections of the driven meander line portion between which said adjacent two transverse conductive sections of the parasitic meander line portion are interposed is not larger than a width of said transverse conductive sections of the driven and parasitic meander line portions.

16. The antenna according to claim 15, wherein gap distances between the respective adjacent two transverse conductive sections of the parasitic meander line portion which are interposed between the corresponding adjacent two transverse conductive sections of the driven meander line portion are not larger than a width of said transverse conductive sections of the driven and parasitic meander line portions.

17. The antenna according to claim 1, wherein said driven and parasitic meander line portions have respective different conductive path lengths.

18. The antenna according to claim 1, having a plurality of resonant frequency values at which an imaginary component of an input impedance is zero, said antenna being operable at a frequency not lower than a second resonant frequency which is a second lowest of said plurality of resonant frequency values.

19. A radio-frequency identification tag for radio communication with a radio-frequency tag communication device, said radio-frequency identification tag including an antenna according to claim 1, and wherein said circuit portion is an IC circuit portion having a memory portion for storing predetermined information.

20. The radio-frequency identification tag according to claim 19, wherein each of said driven meander line portion and said parasitic meander line portion has a conductive path length which is at least ½ of a wavelength of an electromagnetic wave used for the radio communication with said radio-frequency tag communication device.

21. The antenna according to claim 1, further including a substrate, on a surface of which said driven meander line portion, said parasitic meander line portion and said circuit portion are formed, respectively.

* * * * *